US011662678B2

(12) United States Patent
Matsuda et al.

(10) Patent No.: US 11,662,678 B2
(45) Date of Patent: May 30, 2023

(54) FIXING DEVICE WITH CONTROLLED HEATING AND IMAGE FORMING APPARATUS

(71) Applicants: Ryohei Matsuda, Kanagawa (JP); Ryuuichi Mimbu, Kanagawa (JP); Toshihiko Shimokawa, Kanagawa (JP); Satoshi Kuno, Tokyo (JP); Kentaro Yamanaka, Kanagawa (JP)

(72) Inventors: Ryohei Matsuda, Kanagawa (JP); Ryuuichi Mimbu, Kanagawa (JP); Toshihiko Shimokawa, Kanagawa (JP); Satoshi Kuno, Tokyo (JP); Kentaro Yamanaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/534,456

(22) Filed: Nov. 24, 2021

(65) Prior Publication Data

US 2022/0171315 A1 Jun. 2, 2022

(30) Foreign Application Priority Data

Dec. 1, 2020 (JP) ..... JP2020-199733

(51) Int. Cl.
*G03G 15/20* (2006.01)
*G03G 15/00* (2006.01)

(52) U.S. Cl.
CPC ..... *G03G 15/2053* (2013.01); *G03G 15/205* (2013.01); *G03G 15/2042* (2013.01);
(Continued)

(58) Field of Classification Search
USPC ..... 399/328
See application file for complete search history.

(56) References Cited

U.S. PATENT DOCUMENTS

2003/0190170 A1* 10/2003 Hamada ..... G03G 15/205 399/334
2006/0051120 A1 3/2006 Kishi et al.
(Continued)

FOREIGN PATENT DOCUMENTS

EP 2 927 753 A1 10/2015
EP 3 570 114 A1 11/2019
(Continued)

OTHER PUBLICATIONS

Extended European Search Report dated May 9, 2022, in corresponding European Patent Application 21209857.8.

*Primary Examiner* — Quana Grainger
(74) *Attorney, Agent, or Firm* — Xsensus LLP

(57) ABSTRACT

A fixing device includes a fixing rotator over which a recording medium bearing an image is conveyed. A first heater heats the fixing rotator and generates heat evenly in a maximum conveyance span where the recording medium having a maximum width in a width direction of the recording medium is conveyed. The maximum width is available for the fixing rotator. A second heater heats the fixing rotator and generates heat in the maximum conveyance span. The second heater includes a first portion that generates heat in a first heat generation amount and a second portion that generates heat in a second heat generation amount that is greater than the first heat generation amount of the first portion.

11 Claims, 8 Drawing Sheets

(52) U.S. Cl.
CPC ..... *G03G 15/2064* (2013.01); *G03G 15/5045* (2013.01); *G03G 2215/2038* (2013.01)

(56) References Cited

U.S. PATENT DOCUMENTS

| | | | |
|---|---|---|---|
| 2009/0285592 | A1 | 11/2009 | Nakatani et al. |
| 2017/0010571 | A1 | 1/2017 | Matsuda et al. |
| 2017/0017182 | A1 | 1/2017 | Saito et al. |
| 2017/0248885 | A1 | 8/2017 | Saito et al. |
| 2018/0004135 | A1 | 1/2018 | Sako et al. |

FOREIGN PATENT DOCUMENTS

| | | | |
|---|---|---|---|
| EP | 3 696 614 | A1 | 8/2020 |
| JP | 6-19363 | A | 1/1994 |
| JP | 2000-162907 | A | 6/2000 |
| JP | 2000-162909 | | 6/2000 |
| JP | 2009-276549 | | 11/2009 |
| JP | 2016-099590 | | 5/2016 |
| JP | 2017-021325 | | 1/2017 |

* cited by examiner

FIXING DEVICE WITH CONTROLLED HEATING AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-199733, filed on Dec. 1, 2020, in the Japan Patent Office, the entire disclosure of which is hereby incorporated by reference herein.

BACKGROUND

Technical Field

Exemplary aspects of the present disclosure relate to a fixing device and an image forming apparatus, and more particularly, to a fixing device and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data.

Such image forming apparatuses include a fixing device that includes a fixing rotator and a plurality of heaters that heats the fixing rotator. The heaters have different heat generation properties, respectively. The fixing device fixes the image on the recording medium.

SUMMARY

This specification describes below an improved fixing device. In one embodiment, the fixing device includes a fixing rotator over which a recording medium bearing an image is conveyed. A first heater heats the fixing rotator and generates heat evenly in a maximum conveyance span where the recording medium having a maximum width in a width direction of the recording medium is conveyed. The maximum width is available for the fixing rotator. A second heater heats the fixing rotator and generates heat in the maximum conveyance span. The second heater includes a first portion that generates heat in a first heat generation amount and a second portion that generates heat in a second heat generation amount that is greater than the first heat generation amount of the first portion.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
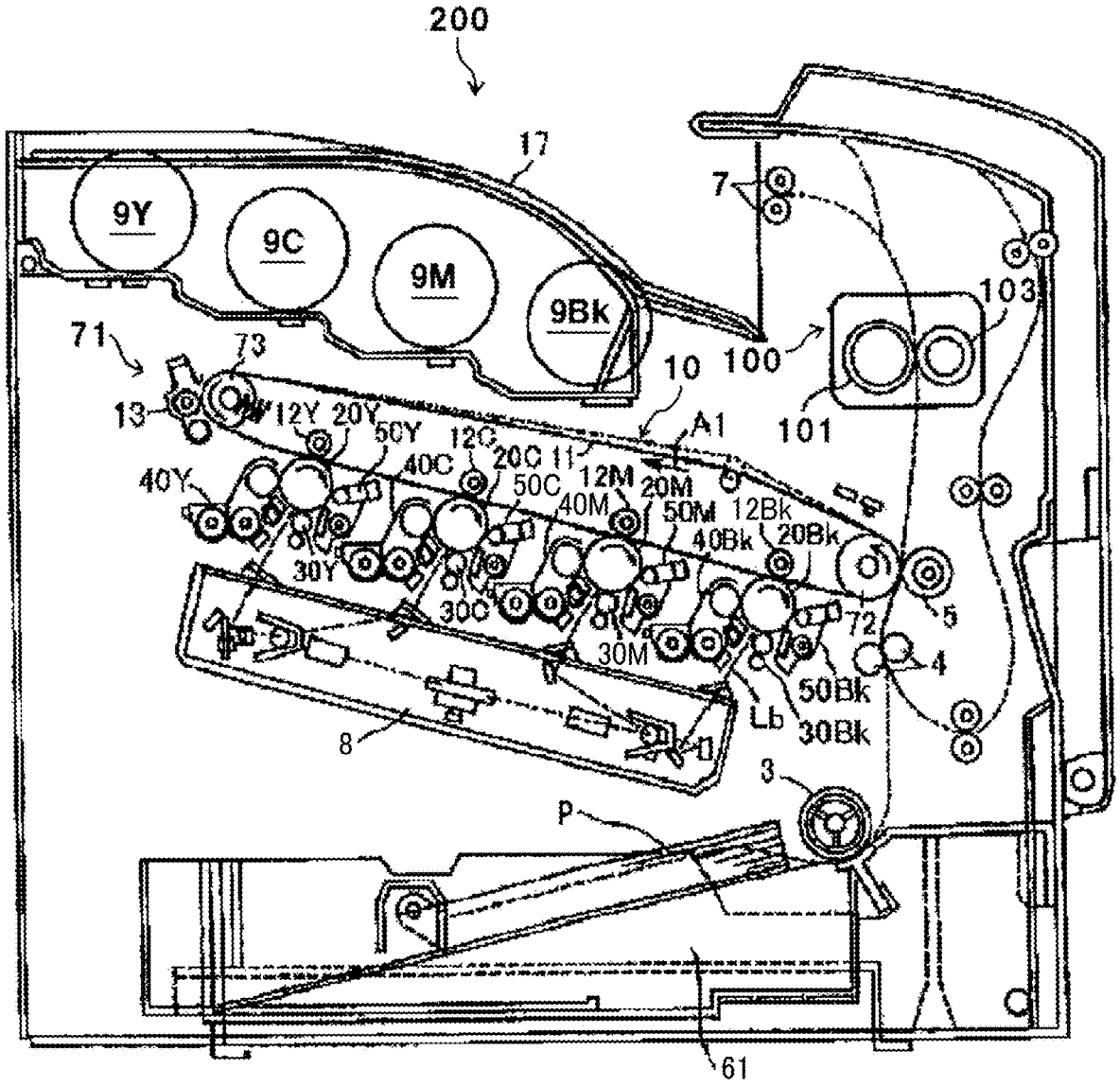
FIG. 1 is a schematic cross-sectional view of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

A description is provided of a construction of a printer 200 according to an embodiment of the present disclosure, that is, a color printer employing an electrophotographic method.

The printer 200 serves as an image forming apparatus incorporating a fixing device according to an embodiment of the present disclosure.

FIG. 1 is a schematic cross-sectional view of the printer 200 according to the embodiment of the present disclosure.

The printer 200 depicted in FIG. 1 is a color printer employing a tandem system in which a plurality of image forming devices that forms images in a plurality of colors, respectively, is arranged in a stretch direction of a transfer belt 11 serving as an intermediate transferor. However, the image forming apparatus employing the fixing device according to the embodiment of the present disclosure is not limited to the printer 200 employing the tandem system. The image forming apparatus employing the fixing device according to the embodiment of the present disclosure may be a copier, a facsimile machine, or the like instead of a printer.

The printer 200 employs the tandem system in which photoconductive drums 20Y, 20C, 20M, and 20Bk are arranged. The photoconductive drums 20Y, 20C, 20M, and 20Bk serve as image bearers that bear images in yellow, cyan, magenta, and black as color separation components, respectively.

In the printer 200, visible images, that is, toner images, formed on the photoconductive drums 20Y, 20C, 20M, and 20Bk, respectively, are primarily transferred onto the transfer belt 11 in a primary transfer process. The transfer belt 11 is an endless belt that rotates in a rotation direction A1 while the transfer belt 11 is disposed opposite the photoconductive drums 20Y, 20C, 20M, and 20Bk. In the primary transfer process, the visible images, that is, yellow, cyan, magenta, and black toner images, are transferred onto the transfer belt 11 such that the yellow, cyan, magenta, and black toner images are superimposed on the transfer belt 11. Thereafter, the visible images formed on the transfer belt 11 are transferred collectively onto a sheet P serving as a recording medium in a secondary transfer process.

Each of the photoconductive drums 20Y, 20C, 20M, and 20Bk is surrounded by image forming units that form the visible image as each of the photoconductive drums 20Y, 20C, 20M, and 20Bk rotates. Taking the photoconductive drum 20Bk that forms the black toner image as an example, a charger 30Bk, a developing device 40Bk, a primary transfer roller 12Bk, and a cleaner 50Bk which form the black toner image are arranged in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y, 50C, and 50M are arranged in a rotation direction of the photoconductive drums 20Y, 20C, and 20M, respectively. An optical writing device 8 is used for optical writing with a light beam Lb after the charger 30Bk charges the photoconductive drum 30Bk uniformly.

While the transfer belt 11 rotates in the rotation direction A1, the toner images formed on the photoconductive drums 20Y, 20C, 20M, and 20Bk, respectively, are transferred onto the transfer belt 11 such that the toner images are superimposed on a same position on the transfer belt 11. The primary transfer rollers 12Y, 12C, 12M, and 12Bk disposed opposite the photoconductive drums 20Y, 20C, 20M, and 20Bk, respectively, via the transfer belt 11 apply a voltage to primarily transfer the toner images formed on the photoconductive drums 20Y, 20C, 20M, and 20Bk at different times from the upstream photoconductive drum 20Y to the downstream photoconductive drum 20Bk in the rotation direction A1 of the transfer belt 11.

The photoconductive drums 20Y, 20C, 20M, and 20Bk are arranged in this order from the upstream photoconductive drum 20Y to the downstream photoconductive drum 20Bk in the rotation direction A1 of the transfer belt 11. Imaging stations that form the yellow, cyan, magenta, and black toner images include the photoconductive drums 20Y, 20C, 20M, and 20Bk, respectively.

The printer 200 includes four imaging stations and a transfer belt unit 10. The four imaging stations form the yellow, cyan, magenta, and black toner images, respectively. The transfer belt unit 10 is disposed opposite and above the photoconductive drums 20Y, 20C, 20M, and 20Bk in FIG. 1. The transfer belt unit 10 includes the transfer belt 11 and the primary transfer rollers 12Y, 12C, 12M, and 12Bk. The printer 200 further includes a secondary transfer roller 5 and a belt cleaner 13. The secondary transfer roller 5 is disposed opposite the transfer belt 11 and rotates in accordance with rotation of the transfer belt 11. The belt cleaner 13 is disposed opposite the transfer belt 11 and cleans the transfer belt 11. The optical writing device 8 is disposed opposite and below the four imaging stations in FIG. 1.

The optical writing device 8 includes a semiconductor laser serving as a light source that writes an electrostatic latent image, a coupling lens, an f-O lens, a toroidal lens, a reflection mirror, and a polygon mirror serving as a deflector. The optical writing device 8 emits light beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively. Although FIG. 1 illustrates the light beam Lb directed to the imaging station that forms the black toner image, the light beams Lb are also directed to the imaging stations that form the yellow, cyan, and magenta toner images, respectively.

The printer 200 further includes a sheet feeder 61 (e.g., a sheet tray) that loads sheets P to be conveyed to a secondary transfer nip formed between the secondary transfer roller 5 and the transfer belt 11. The printer 200 further includes a registration roller pair 4 that feeds a sheet P conveyed from the sheet feeder 61 to the secondary transfer nip formed between the secondary transfer roller 5 and the transfer belt 11 at a predetermined time when the yellow, cyan, magenta, and black toner images formed on the transfer belt 11 by the imaging stations, respectively, reach the secondary transfer nip. The printer 200 further includes a sensor that detects that a leading edge of the sheet P reaches the registration roller pair 4.

The printer 200 further includes a fixing device 100, a sheet ejecting roller pair 7, an output tray 17, and toner bottles 9Y, 9C, 9M, and 9Bk. The fixing device 100 is a fuser unit that fixes a color toner image on the sheet P while the fixing device 100 contacts and heats the sheet P. The color toner image is formed by transferring the yellow, cyan, magenta, and black toner images formed on the transfer belt 11 onto the sheet P. The sheet ejecting roller pair 7 ejects the sheet P bearing the fixed color toner image onto an outside of a body of the printer 200. The output tray 17 is disposed atop the body of the printer 200. The output tray 17 stacks the sheets P ejected onto the outside of the body of the printer 200 by the sheet ejecting roller pair 7. The toner bottles 9Y, 9C, 9M, and 9Bk are disposed below the output tray 17 in FIG. 1 and disposed inside the body of the printer 200. The toner bottles 9Y, 9C, 9M, and 9Bk are replenished with yellow, cyan, magenta, and black toners, respectively.

In addition to the transfer belt 11 and the primary transfer rollers 12Y, 12C, 12M, and 12Bk, the transfer belt unit 10 includes a driving roller 72 and a driven roller 73 over which the transfer belt 11 is looped.

The driven roller 73 also serves as a tension applicator that applies tension to the transfer belt 11. A biasing member such as a spring biases the driven roller 73 against the transfer belt 11. The transfer belt unit 10, the primary transfer rollers 12Y, 12C, 12M, and 12Bk, the secondary transfer roller 5, and the belt cleaner 13 construct a transfer device 71.

The sheet feeder 61 is disposed in a lower portion of the body of the printer 200. The sheet feeder 61 includes a sheet feeding roller 3 that comes into contact with an upper surface of an uppermost sheet P. As the sheet feeding roller 3 is driven and rotated counterclockwise in FIG. 1, the sheet feeding roller 3 feeds the uppermost sheet P to the registration roller pair 4.

The belt cleaner 13 installed in the transfer device 71 includes a cleaning brush and a cleaning blade that are disposed opposite and brought into contact with the transfer belt 11. The cleaning brush and the cleaning blade of the belt cleaner 13 scrape and remove a foreign substance such as residual toner from the transfer belt 11, cleaning the transfer belt 11.

The belt cleaner 13 further includes a discharging device that conveys the residual toner removed from the transfer belt 11 for disposal.

A description is provided of a construction of the fixing device 100 incorporated in the printer 200.

Figure 2:
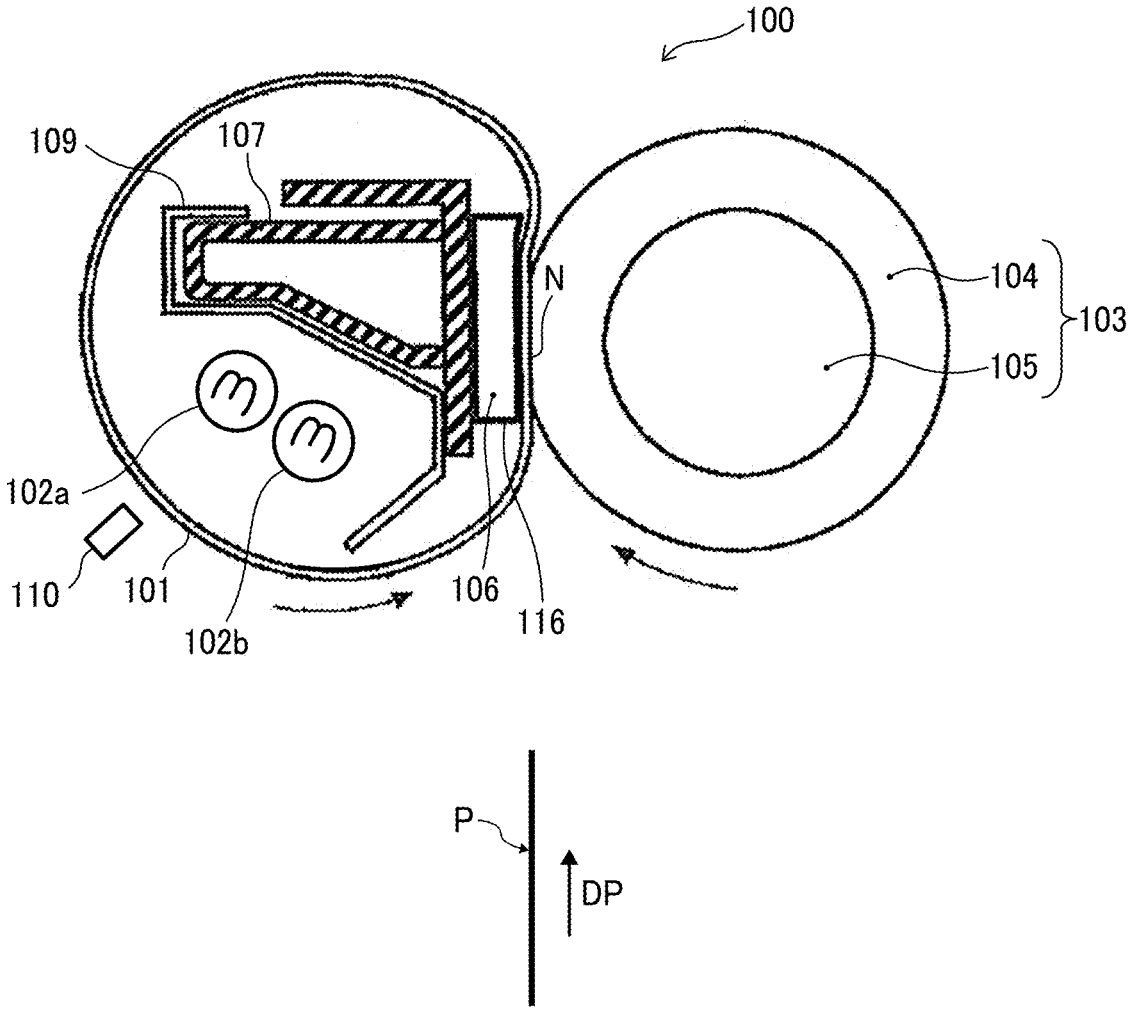
FIG. 2 is a schematic cross-sectional view of a fixing device incorporated in the printer depicted in FIG. 1.

FIG. 2 is a schematic cross-sectional view of the fixing device 100.

The fixing device 100 includes a fixing belt 101 and a pressure roller 103. The fixing belt 101 serves as a fixing rotator that is rotatable in a rotation direction indicated with an arrow in FIG. 2. The pressure roller 103 serves as a pressure rotator that is disposed opposite the fixing belt 101 and rotatable in a rotation direction indicated with an arrow in FIG. 2. Within a loop formed by the fixing belt 101 are a main heater 102*a* serving as a first heater, a sub heater 102*b* serving as a second heater, a pad 106 serving as a nip formation pad, a support 107, a slide aid 116, a reflector 109, and the like. Each of the main heater 102*a*, the sub heater 102*b*, the pad 106, the support 107, the slide aid 116, and the reflector 109 that are disposed within the loop formed by the fixing belt 101 has a length that is greater than a length of the fixing belt 101 in an axial direction thereof.

The fixing belt 101 is an endless belt or film made of metal such as nickel and stainless used steel (SUS) or a resin material such as polyimide. The fixing belt 101 includes a base layer and a release layer. The release layer serves as a surface layer made of perfluoroalkoxy alkane (PFA), polytetrafluoroethylene (PTFE), or the like, facilitating separation of toner of the toner image on the sheet P from the fixing belt 101 and preventing the toner from adhering to the fixing belt 101. Optionally, an elastic layer made of silicone rubber or the like may be interposed between the base layer and the release layer. If the fixing belt 101 does not incorporate the elastic layer, the fixing belt 101 attains a decreased thermal capacity that improves a fixing property of being heated quickly. However, when the pressure roller 103 presses and deforms an unfixed toner image to fix the toner image on the sheet P, slight surface asperities of the fixing belt 101 may be transferred onto the toner image, causing a disadvantage that an orange peel mark remains on a solid part of the toner image as uneven gloss of the toner image or an orange peel image. To address this circumstance, the elastic layer has a thickness of 100 μm or more. As the elastic layer deforms, the elastic layer absorbs the slight surface asperities, preventing the orange peel mark on the toner image.

The pressure roller 103 includes a core metal 105, an elastic rubber layer 104, and a release layer. The elastic rubber layer 104 is disposed on the core metal 105. The release layer serves as a surface layer that facilitates separation of the sheet P from the pressure roller 103. The release layer is made of PFA, PTFE, or the like. A driving force is transmitted to the pressure roller 103 from a driver such as a motor disposed in the printer 200 through a gear, thus rotating the pressure roller 103. A spring or the like presses the pressure roller 103 against the fixing belt 101. As the spring presses and deforms the elastic rubber layer 104, the pressure roller 103 forms a fixing nip N having a predetermined length in a sheet conveyance direction DP. Alternatively, the pressure roller 103 may be a hollow roller. A heater such as a halogen heater may be disposed inside the pressure roller 103 as the hollow roller. The elastic rubber layer 104 may be made of solid rubber. Alternatively, if no heater is disposed inside the pressure roller 103, sponge rubber may be used. The sponge rubber enhances thermal insulation of the pressure roller 103, preferably causing the pressure roller 103 to draw less heat from the fixing belt 101.

The pad 106 serving as a nip formation pad is disposed within the loop formed by the fixing belt 101. The pad 106 is disposed opposite the pressure roller 103 via the fixing belt 101 to form the fixing nip N between the fixing belt 101 and the pressure roller 103. The pad 106 mounts the slide aid 116 over which an inner circumferential surface of the fixing belt 101 slides. The support 107 supports the pad 106.

The pad 106 depicted in FIG. 2 has an opposed face that is disposed opposite the pressure roller 103 and is planar. Alternatively, the opposed face of the pad 106 may be curved or recessed or may have other shapes. If the opposed face of the pad 106 is recessed, the opposed face of the pad 106 causes the fixing nip N to be recessed toward the fixing belt 101. Accordingly, the fixing nip N directs the leading edge of the sheet P toward the pressure roller 103 when the sheet P is ejected from the fixing nip N, facilitating separation of the sheet P from the fixing belt 101 and thereby preventing the sheet P from being jammed.

The support 107 prevents the pad 106 from being bent by pressure received from the pressure roller 103, attaining a uniform length of the fixing nip N in the sheet conveyance direction DP throughout an entire span of the fixing belt 101 in the axial direction thereof.

Each of the main heater 102*a* and the sub heater 102*b* is a halogen heater. The main heater 102*a* and the sub heater 102*b* disposed opposite the inner circumferential surface of the fixing belt 101 heat the fixing belt 101 directly with radiant heat. Alternatively, each of the main heater 102*a* and the sub heater 102*b* may be an induction heater (IH), a resistive heat generator, a carbon heater, or the like as long as the main heater 102*a* and the sub heater 102*b* heat the fixing belt 101.

According to this embodiment, the reflector 109 (e.g., a reflecting plate) is interposed between the main heater 102*a* and the support 107 and between the sub heater 102*b* and the support 107. The reflector 109 reflects radiant heat and the like from the main heater 102*a* and the sub heater 102*b*, preventing the radiant heat and the like from heating the support 107 and suppressing resultant waste of energy. Alternatively, instead of the reflector 109, a surface of the support 107 may be treated with thermal insulation or specular surface finish to attain similar advantages.

Outside the loop formed by the fixing belt 101 is a temperature detecting sensor 110 that detects the temperature of a surface of the fixing belt 101. The temperature detecting sensor 110 is a temperature sensor, such as a thermopile, that has an enhanced temperature responsiveness. The temperature detecting sensor 110 is disposed opposite a center span CS of the fixing belt 101 in the axial direction thereof and detects the temperature of the center span CS of the fixing belt 101 as described below with reference to FIG. 6.

The fixing belt 101 rotates in accordance with rotation of the pressure roller 103. With the construction of the fixing device 100 depicted in FIG. 2, as the driver drives and rotates the pressure roller 103, the driving force is transmitted from the pressure roller 103 to the fixing belt 101 at the fixing nip N, rotating the fixing belt 101 in accordance with rotation of the pressure roller 103. As a sheet P bearing a toner image is conveyed through the fixing nip N, the fixing belt 101 and the pressure roller 103 fix the toner image on the sheet P under heat and pressure.

With the construction described above, the fixing device 100 improves productivity and fixing performance at reduced costs.

Figure 3B:
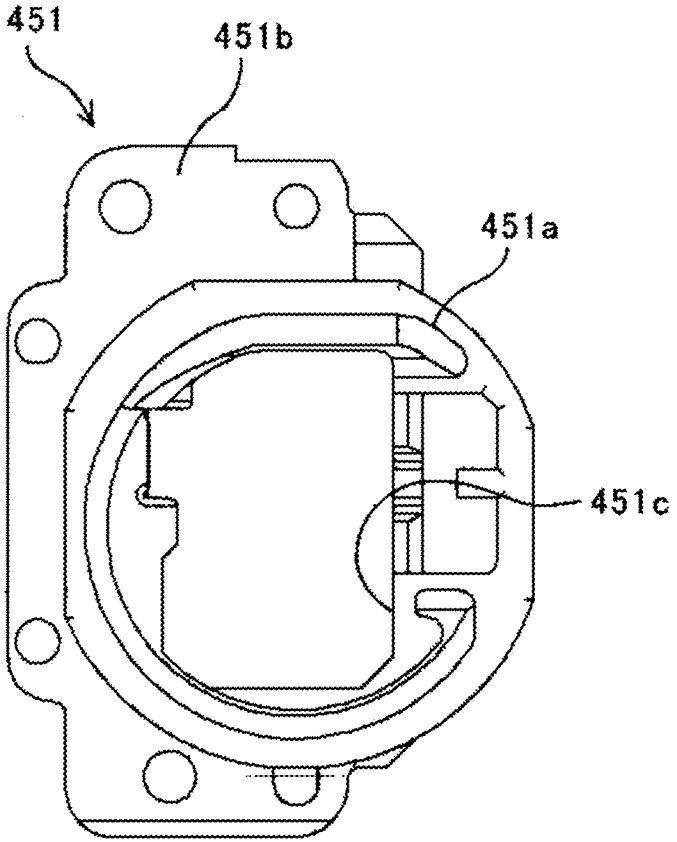
FIG. 3B is a front view of the guide depicted in FIG. 3A.
Figure 3A:
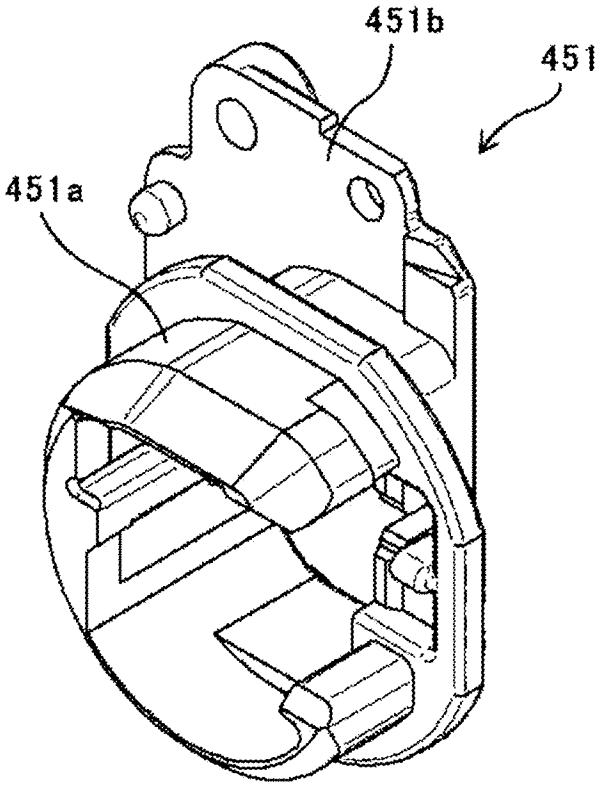
FIG. 3A is a perspective view of a guide incorporated in the fixing device depicted in FIG. 2.

FIG. 3A is a perspective view of a guide 451 incorporated in the fixing device 100. FIG. 3B is a front view of the guide 451.

The guides 451 having an identical shape are disposed opposite both lateral ends of the fixing belt 101 in the axial direction thereof, respectively. As illustrated in FIGS. 3A and 3B, the guide 451 includes an attachment portion 451*b* and a guide portion 451*a*. The attachment portion 451*b* is attached to a side plate of the fixing device 100. The guide portion 451*a* is disposed opposite the inner circumferential surface of the fixing belt 101 at a lateral end of the fixing belt 101 in the axial direction thereof.

The guide portion 451*a* is substantially tubular and has a slit disposed opposite the pressure roller 103. An outer diameter of the guide portion 451*a* is equivalent to an inner diameter of the fixing belt 101. The guide portion 451*a* has a length in the axial direction of the fixing belt 101, that is defined inward from a lateral edge of the fixing belt 101 in the axial direction thereof, when the guide portion 451*a* is inserted into the fixing belt 101 for a predetermined amount. As the guide portion 451*a* is inserted into the fixing belt 101 at the lateral end of the fixing belt 101 in the axial direction thereof such that the fixing belt 101 slides over the guide portion 451*a*, the guide portion 451*a* retains a circular shape of the fixing belt 101 in cross section.

As illustrated in FIG. 3B, the attachment portion 451*b* includes a through hole 451*c* disposed opposite an interior of the guide portion 451*a*. The support 107, the main heater 102*a*, and the sub heater 102*b* are attached to the side plate of the fixing device 100 through the through hole 451*c*.

Figure 4:
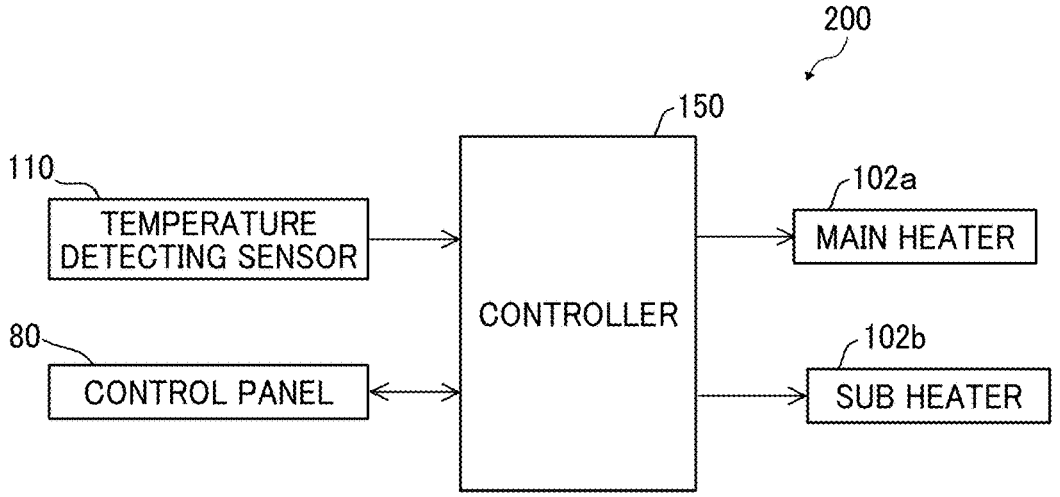
FIG. 4 is a block diagram of the printer depicted in FIG. 1, illustrating a controller that controls turning on of each of a main heater and a sub heater incorporated in the fixing device depicted in FIG. 2.

FIG. 4 is a block diagram of the printer 200, illustrating a controller 150 that controls turning on of each of the main heater 102*a* and the sub heater 102*b* of the fixing device 100.

The controller 150 includes a central processing unit (CPU), a read only memory (ROM), a random access memory (RAM), and a nonvolatile flash memory. The ROM is a memory that is read-only and stores a control program. The RAM is a memory that is readable and writable and stores data temporarily. The controller 150 is connected to the main heater 102*a*, the sub heater 102*b*, the temperature detecting sensor 110, and a control panel 80. The control panel 80 includes a display and a control portion and receives an instruction input by a user.

The nonvolatile flash memory stores data relating to a size of a sheet P placed in the sheet feeder 61, that is input by the user using the control panel 80. The controller 150 controls turning on of each of the main heater 102*a* and the sub heater 102*b* based on the data relating to the size of the sheet P, that is stored in the nonvolatile flash memory, and a temperature of the fixing belt 101, that is detected by the temperature detecting sensor 110.

A description is provided of a construction of a comparative fixing device.

The comparative fixing device includes a main heater and a sub heater. The main heater includes a center portion and lateral end portions in a longitudinal direction of the main heater. The main heater has a heat generation property in which a heat generation amount of the center portion is greater than a heat generation amount of each of the lateral end portions. The sub heater includes a center portion and lateral end portions in a longitudinal direction of the sub heater. The sub heater has a heat generation property in which a heat generation amount of each of the lateral end portions is greater than a heat generation amount of the center portion. The comparative fixing device further includes a first temperature detecting sensor and a second temperature detecting sensor. The first temperature detecting sensor detects a temperature of a center span of a fixing rotator in an axial direction thereof. The second temperature detecting sensor detects a temperature of a lateral end span of the fixing rotator in the axial direction thereof. A controller controls the main heater based on the temperature of the center span of the fixing rotator, that is detected by the first temperature detecting sensor. The controller controls the sub heater based on the temperature of the lateral end span of the fixing rotator, that is detected by the second temperature detecting sensor. The heat generation amount of each of the lateral end portions of the sub heater is greater than the heat generation amount of the center portion of the main heater.

However, the comparative fixing device may be constructed of parts in an increased number, increasing manufacturing costs.

Figure 5:
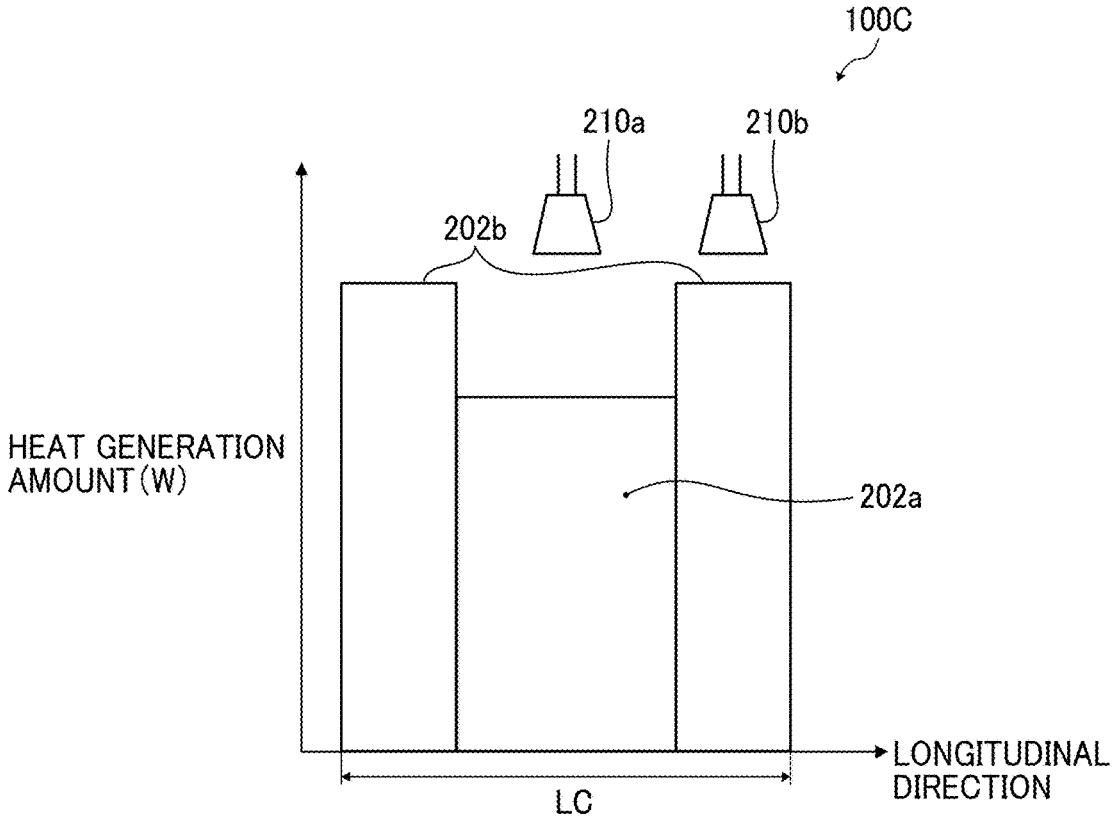
FIG. 5 is a diagram of a comparative fixing device, illustrating a configuration of a main heater and a sub heater incorporated therein.

FIG. 5 is a diagram of a comparative fixing device 100C, illustrating a configuration of heaters incorporated therein.

As illustrated in FIG. 5, the comparative fixing device 100C includes a center heater 202*a* and a lateral end heater 202*b*. The center heater 202*a* has a heat generation property in which a center portion of the center heater 202*a* in a longitudinal direction thereof generates heat solely. The lateral end heater 202*b* has a heat generation property in which lateral end portions of the lateral end heater 202*b* in a longitudinal direction thereof generate heat solely. A heat generation span LC produced when the center heater 202*a* and the lateral end heater 202*b* are turned on is not smaller than a maximum conveyance span in an axial direction of a fixing belt where a sheet having a maximum width is conveyed over the fixing belt.

The comparative fixing device 100C further includes a lateral end temperature detecting sensor 210*b* and a center temperature detecting sensor 210*a*. The lateral end temperature detecting sensor 210*b* detects a temperature of a lateral end span of the fixing belt in the axial direction thereof. The center temperature detecting sensor 210*a* detects a temperature of a center span of the fixing belt in the axial direction thereof. When a large sheet is conveyed over the fixing belt, a controller controls turning on of the lateral end heater 202*b* based on the temperature of the lateral end span of the fixing belt, that is detected by the lateral end temperature detecting sensor 210*b*. The controller controls turning on of the center heater 202*a* based on the temperature of the center span of the fixing belt, that is detected by the center temperature detecting sensor 210*a*. Accordingly, the center heater 202*a* and the lateral end heater 202*b* retain the fixing belt at a predetermined fixing temperature substantially throughout an entire span of the fixing belt in the axial direction thereof.

The comparative fixing device 100C includes the center heater 202*a* and the lateral end heater 202*b* that have the heat generation properties described above, respectively. Hence, when a small sheet is conveyed over the fixing belt, the controller turns off the lateral end heater 202*b*, thus allowing the fixing belt to fix a toner image on the small sheet without causing the lateral end heater 202*b* to heat the lateral end spans of the fixing belt in the axial direction thereof. Accordingly, when printing is performed continuously on a great number of small sheets with a short interval between successive small sheets, the comparative fixing device 100C suppresses overheating of the lateral end spans of the fixing belt in the axial direction thereof. However, image forming apparatuses located in offices barely print a great number of sheets continuously and are barely requested to improve productivity in continuous printing. The image forming apparatuses located in the offices are requested to shorten a first print out time at reduced costs.

Figure 6:
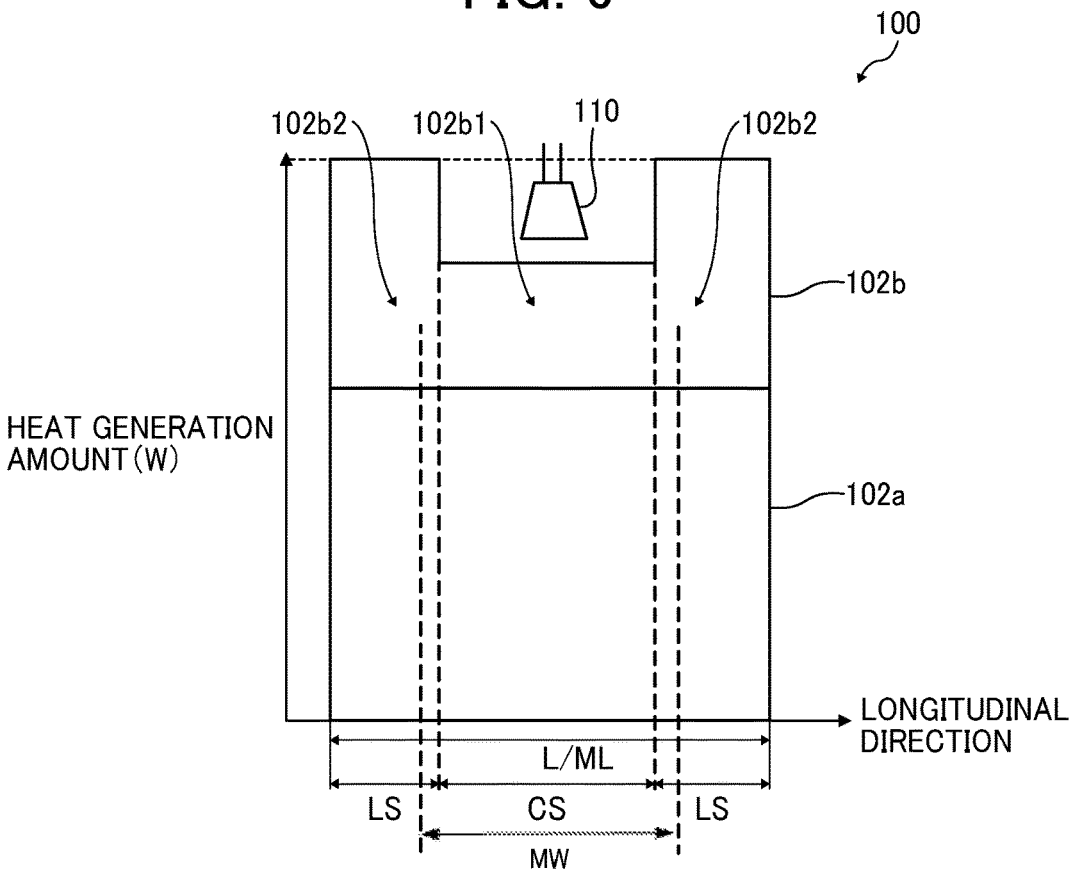
FIG. 6 is a diagram of the fixing device depicted in FIG. 2, illustrating a configuration of the main heater and the sub heater incorporated therein.

To address this circumstance of the comparative fixing device 100C, as illustrated in FIG. 6, the fixing device 100 according to the embodiment of the present disclosure includes the main heater 102*a* and the sub heater 102*b*. The main heater 102*a* has a heat generation property in which the main heater 102*a* generates heat evenly in a longitudinal direction thereof. The sub heater 102*b* includes a center portion 102*b*1 and lateral end portions 102*b*2 arranged with the center portion 102*b*1 in a longitudinal direction of the sub heater 102*b*. The sub heater 102*b* has a heat generation property in which a heat generation amount of each of the lateral end portions 102*b*2 is greater than a heat generation amount of the center portion 102*b*1. Accordingly, the fixing device 100 reduces the number of temperature detecting sensors and manufacturing costs compared to the comparative fixing device 100C depicted in FIG. 5. The controller 150 turns on both the main heater 102*a* and the sub heater 102*b*, heating the fixing belt 101 quickly to the fixing temperature substantially evenly in the axial direction of the fixing belt 101 and thus suppressing degradation in the first print out time for a large sheet.

Referring to drawings, a description is provided of a construction of the fixing device 100 specifically.

FIG. 6 is a diagram of the fixing device 100 according to the embodiment of the present disclosure, illustrating a configuration of the main heater 102*a* and the sub heater 102*b*.

As illustrated in FIG. 6, the fixing device 100 includes the main heater 102*a* and the sub heater 102*b*. The main heater 102*a* has the heat generation property in which the main heater 102*a* generates heat evenly in the longitudinal direction thereof. The sub heater 102*b* has the heat generation property in which the heat generation amount of each of the lateral end portions 102*b*2 is greater than the heat generation amount of the center portion 102*b*1.

A heat generation span L produced by the main heater 102*a* and the sub heater 102*b* is not smaller than a maximum conveyance span ML in the axial direction of the fixing belt 101 where a sheet having a maximum width MW available in the printer 200 is conveyed over the fixing belt 101. The heat generation amount of the center portion 102*b*1 of the sub heater 102*b* is smaller than a heat generation amount of the main heater 102*a* in the center span CS. According to this embodiment, a single temperature detecting sensor, that is, the temperature detecting sensor 110, is disposed opposite the center span CS of the fixing belt 101. The controller 150 controls the main heater 102*a* and the sub heater 102*b* by using the single, temperature detecting sensor 110 so that the fixing belt 101 retains a predetermined temperature (e.g., a standby temperature or a fixing temperature). According to this embodiment, the temperature detecting sensor 110 is disposed opposite the center span CS of the fixing belt 101. Alternatively, the temperature detecting sensor 110 may be disposed opposite other span of the fixing belt 101 in the axial direction thereof where a sheet having a minimum width available in the printer 200 is conveyed over the fixing belt 101. According to this embodiment, the minimum width is a width of 105 mm of an A6 size sheet in portrait orientation.

Figure 7:
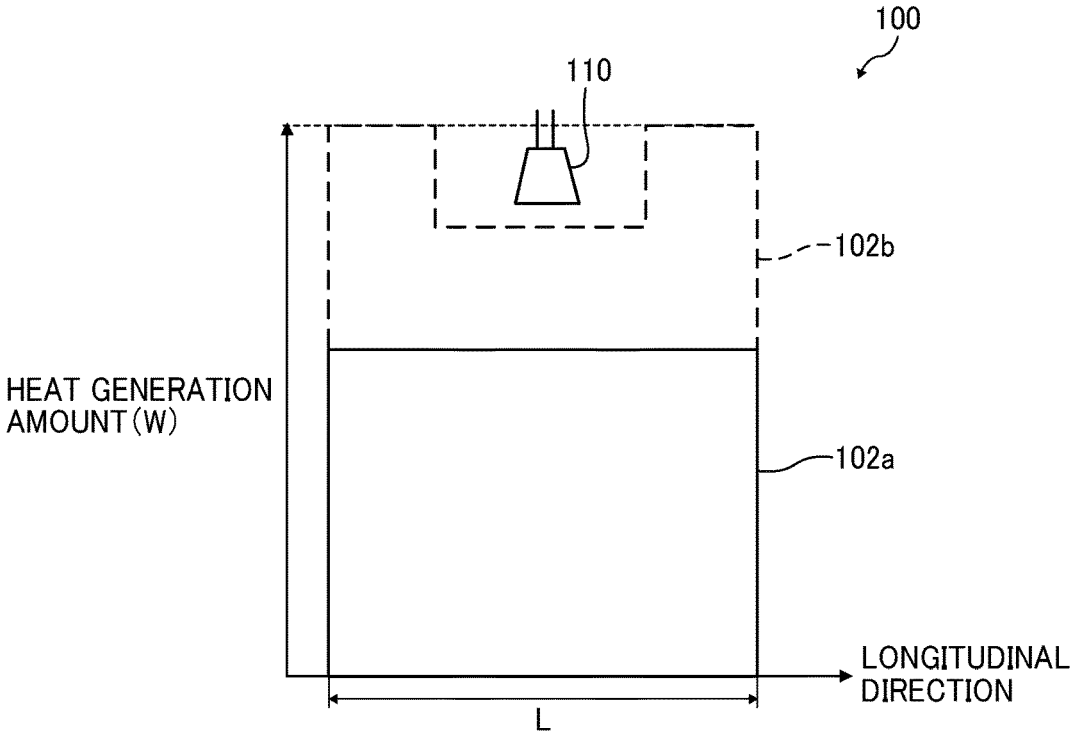
FIG. 7 is a diagram of the fixing device depicted in FIG. 6, illustrating a heat generation amount when the sub heater is turned off.

As illustrated in FIG. 6, a total heat generation amount obtained by adding a heat generation amount of the lateral end portion 102*b*2 of the sub heater 102*b* to a heat generation amount of a lateral end span LS of the main heater 102*a* in the longitudinal direction thereof when both the sub heater 102*b* and the main heater 102*a* are turned on is greater than a total heat generation amount obtained by adding a heat generation amount of the center portion 102*b*1 of the sub heater 102*b* to a heat generation amount of the center span CS of the main heater 102*a*. Conversely, when the sub heater 102*b* is turned off and the main heater 102*a* is turned on, as illustrated in FIG. 7, the main heater 102*a* attains a heat generation amount that is substantially even in the longitudinal direction of the main heater 102*a*, heating the fixing belt 101 substantially evenly in the axial direction thereof.

According to this embodiment, the center portion 102*b*1 of the sub heater 102*b* attains a predetermined heat generation amount. Alternatively, the center portion 102*b*1 of the sub heater 102*b* may provide a heat generation amount of 0 [W].

Figure 8:
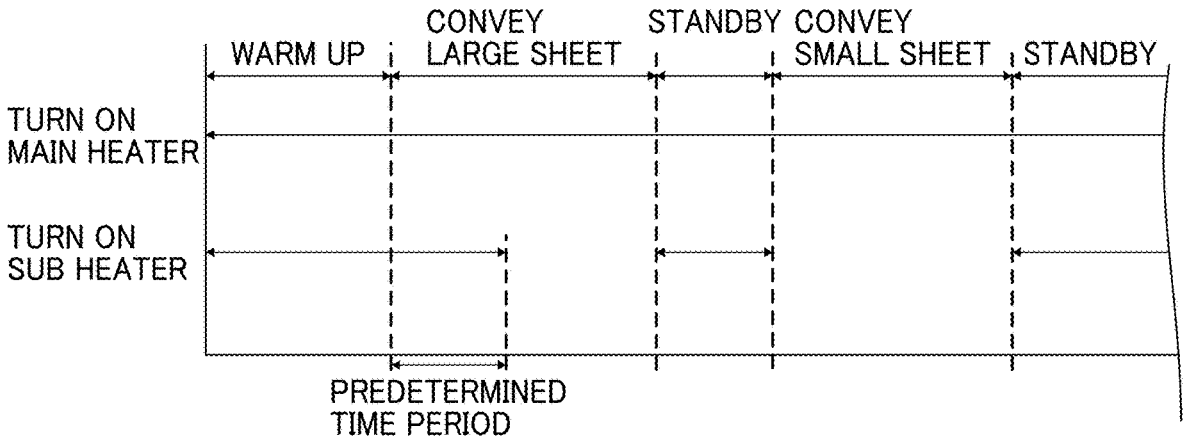
FIG. 8 is a timing chart of a control for turning on each of the main heater and the sub heater depicted in FIG. 6 as one example.

FIG. 8 is a timing chart of a control for turning on each of the main heater 102*a* and the sub heater 102*b* as one example.

The controller 150 turns on both the sub heater 102*b* and the main heater 102*a* when the printer 200 is powered on for warming up.

When the printer 200 is warmed up to heat the fixing belt 101 to the predetermined temperature (e.g., the fixing temperature or the standby temperature), the guides 451 serving as lateral end contact members draw heat from the lateral end spans LS of the fixing belt 101 because the guides 451 include the guide portions 451*a* that contact both lateral ends of the fixing belt 101 in the axial direction thereof, respectively. Both lateral ends of the fixing belt 101 in the axial direction thereof slide over the guide portions 451*a*, respectively. Hence, the lateral end spans LS of the fixing belt 101 are subject to temperature decrease in which the temperature of each of the lateral end spans LS of the fixing belt 101 decreases compared to the temperature of the center span CS of the fixing belt 101.

To address this circumstance, the controller 150 for the fixing device 100 according to this embodiment turns on both the sub heater 102*b* and the main heater 102*a* when the fixing device 100 is warmed up, thus increasing the heat generation amount of the sub heater 102*b* and the main heater 102*a* in each of the lateral end spans LS of the fixing belt 101 compared to the center span CS of the fixing belt 101. Accordingly, even if the guides 451 draw heat slightly from the lateral end spans LS of the fixing belt 101, respectively, the fixing device 100 suppresses temperature decrease in the lateral end spans LS of the fixing belt 101. Accordingly, the fixing device 100 causes the sub heater 102*b* and the main heater 102*a* to heat each of the lateral end spans LS of the fixing belt 101 to the predetermined temperature (e.g., the fixing temperature or the standby temperature) quickly like the center span CS of the fixing belt 101. Consequently, the fixing device 100 shortens a warm up time taken after the printer 200 is powered on until the fixing device 100 is heated to the predetermine temperature and a first print out time taken after the printer 200 receives an instruction to start printing until a trailing edge of a first sheet P is ejected onto the output tray 17. Additionally, the fixing device 100 attains proper fixing performance for fixing a toner image on a sheet P conveyed over the fixing belt 101 first after warming up of the fixing belt 101 is finished even in the lateral end spans LS of the fixing belt 101.

According to this embodiment, when a large sheet P is conveyed through the fixing nip N, the controller 150 turns on both the sub heater 102*b* and the main heater 102*a*. As the controller 150 turns on both the sub heater 102*b* and the main heater 102*a*, the fixing device 100 prevents the fixing belt 101 from fixing a toner image on a sheet P while the lateral end spans LS of the fixing belt 101 suffer from temperature decrease, thus suppressing faulty fixing of the toner image in the lateral end spans LS of the sheet P. According to this embodiment, a large sheet P has an increased width in a width direction thereof parallel to the axial direction of the fixing belt 101. The increased width is not smaller than a width of 257 mm of a B4 size sheet in portrait orientation. A small sheet P has a decreased width in a width direction thereof parallel to the axial direction of the fixing belt 101. The decreased width is smaller than the width of the B4 size sheet in portrait orientation. Alternatively, the increased width and the decreased width may be defined properly according to a configuration of an image forming apparatus (e.g., the printer 200).

When a predetermined time period elapses after conveyance of a sheet P starts (e.g., after fixing starts), the controller 150 turns off the sub heater 102*b*. The controller 150 turns on the main heater 102*a* based on a detection result sent from the temperature detecting sensor 110, retaining the fixing belt 101 at the fixing temperature.

Immediately after fixing starts, the guides 451 have a temperature not higher than the fixing temperature. Hence, heat is conducted from the lateral end spans LS of the fixing belt 101 to the guides 451. Conversely, after the predetermined time period elapses, the guides 451 are heated to a temperature close to the fixing temperature, decreasing conduction of heat from the lateral end spans LS of the fixing belt 101 to the guides 451. As described above, the length of the fixing belt 101 in the axial direction thereof is not smaller than the maximum width of the sheet P available in the printer 200. Hence, both lateral ends of the fixing belt 101 in the axial direction thereof do not directly contact the sheet P having the maximum width. Accordingly, the lateral end spans LS of the fixing belt 101 are less susceptible to drawing of heat by the sheet P than the center span CS of the fixing belt 101. As conduction of heat from the lateral end spans LS of the fixing belt 101 to the guides 451 decreases, an amount of heat drawn from each of the lateral end spans LS of the fixing belt 101 by a sheet P conveyed over the lateral end spans LS of the fixing belt 101 and the guides 451 is equivalent to an amount of heat drawn from the center span CS of the fixing belt 101 by the sheet P conveyed over the center span CS of the fixing belt 101. As a result, even if the heat generation amount of each of the sub heater 102*b* and the main heater 102*a* in each of the lateral end spans LS is not greater than the heat generation amount of each of the sub heater 102*b* and the main heater 102*a* in the center span CS, the lateral end spans LS of the fixing belt 101 do not suffer from temperature decrease. Thus, the fixing belt 101 retains the fixing temperature substantially throughout the entire span of the fixing belt 101 in the axial direction thereof.

When the controller 150 turns on the main heater 102*a* without turning on the sub heater 102*b*, as illustrated in FIG. 7, the main heater 102*a* attains the heat generation amount that is substantially even in the longitudinal direction of the main heater 102*a*, heating the fixing belt 101 substantially evenly in the axial direction thereof. Accordingly, after the fixing device 100 attains a condition in which the lateral end spans LS of the fixing belt 101 are immune from temperature decrease, the controller 150 controls turning on of the main heater 102*a* based on a temperature of the fixing belt 101, that is detected by the temperature detecting sensor 110 disposed opposite the center span CS of the fixing belt 101. Consequently, the fixing belt 101 retains the fixing temperature substantially throughout the entire span of the fixing belt 101 in the axial direction thereof, thus suppressing faulty fixing of a toner image in the lateral end spans LS of a sheet P.

According to this embodiment, the main heater 102*a* has the heat generation property in which the main heater 102*a* generates heat substantially evenly in the longitudinal direction thereof. After the fixing device 100 attains the condition in which the lateral end spans LS of the fixing belt 101 are immune from temperature decrease, the controller 150 performs a control described below to retain the fixing belt 101 at the fixing temperature substantially throughout the entire span of the fixing belt 101 in the axial direction thereof. For example, the controller 150 turns off the sub heater 102*b* and turns on the main heater 102*a* based on the detection result sent from the temperature detecting sensor 110. Accordingly, the fixing device 100 eliminates the lateral end temperature detecting sensor 210*b* of the comparative fixing device 100C depicted in FIG. 5, that is used to control turning on of the sub heater 202*b* to retain both lateral end spans of the fixing belt in the axial direction thereof at the fixing temperature. Thus, the fixing device 100 reduces the number of parts and manufacturing costs compared to the comparative fixing device 100C depicted in FIG. 5.

When a small sheet P having the decreased width is conveyed through the fixing nip N, the controller 150 turns on the main heater 102*a* without turning on the sub heater 102*b* based on the detection result sent from the temperature detecting sensor 110, retaining the fixing belt 101 at the fixing temperature.

When the small sheet P is conveyed over the fixing belt 101, a toner image on the small sheet P passes over an inboard span that is inboard from both lateral ends of the fixing belt 101 in the axial direction thereof. Both lateral ends of the fixing belt 101 may suffer from temperature decrease. Hence, the toner image on the small sheet P is immune from an adverse effect caused by temperature decrease of the fixing belt 101. Accordingly, when the small sheet P or a sheet P bearing a toner image having a decreased width in the width direction of the sheet P is conveyed over the fixing belt 101, the controller 150 does not turn on the sub heater 102*b* and turns on the main heater 102*a*. Thus, the fixing device 100 reduces power consumption compared to a configuration in which the controller 150 turns on both the sub heater 102*b* and the main heater 102*a* to fix a toner image on a sheet P. Additionally, the fixing device 100 suppresses overheating of the lateral end spans LS of the fixing belt 101 compared to the configuration in which the controller 150 turns on both the sub heater 102*b* and the main heater 102*a*.

In a standby mode in which the fixing device 100 waits for a fixing job, for example, the controller 150 turns on both the main heater 102*a* and the sub heater 102*b* based on a detection result sent from the temperature detecting sensor 110, retaining the fixing belt 101 at the standby temperature.

In the standby mode, heat is not drawn from the fixing belt 101 by a sheet P. Conversely, the guides 451 draw heat from the lateral end spans LS of the fixing belt 101, respectively, even in the standby mode. As a result, if the controller 150 is configured to turn on the main heater 102*a*, without turning on the sub heater 102*b*, based on a detection result sent from the temperature detecting sensor 110 that detects the temperature of the center span CS of the fixing belt 101 so as to retain the fixing belt 101 at the standby temperature, a disadvantage below may occur. For example, a temperature difference between each of the lateral end spans LS and the center span CS of the fixing belt 101 increases gradually, causing a temperature of each of the lateral end spans LS of the fixing belt 101 to be lower than a temperature of the center span CS of the fixing belt 101 disadvantageously.

To address this circumstance, according to this embodiment, in the standby mode, the controller 150 turns on both the sub heater 102*b* and the main heater 102*a* based on the detection result sent from the temperature detecting sensor 110, retaining the fixing belt 101 at the standby temperature. As described above, the controller 150 turns on both the sub heater 102*b* and the main heater 102*a*, causing the combined heat generation amount that combines the heat generation amount of the sub heater 102*b* and the heat generation amount of the main heater 102*a* in each of the lateral end spans LS to be greater than the combined heat generation amount of the heat generation amount of the sub heater 102*b* and the heat generation amount of the main heater 102*a* in the center span CS. Thus, in the standby mode, the fixing device 100 prevents a temperature of each of the lateral end spans LS of the fixing belt 101 from being lower than a temperature of the center span CS of the fixing belt 101. Additionally, in the standby mode, heat is not drawn from the fixing belt 101 by the sheet P. Hence, the fixing device 100 decreases a lighting amount of the main heater 102*a* and the sub heater 102*b* per unit time to retain the fixing belt 101 at the standby temperature. Accordingly, even if a difference between the combined heat generation amount in each of the lateral end spans LS and the combined heat generation amount in the center span CS increases slightly, the lateral end spans LS of the fixing belt 101 are immune from overheating.

Figure 9:
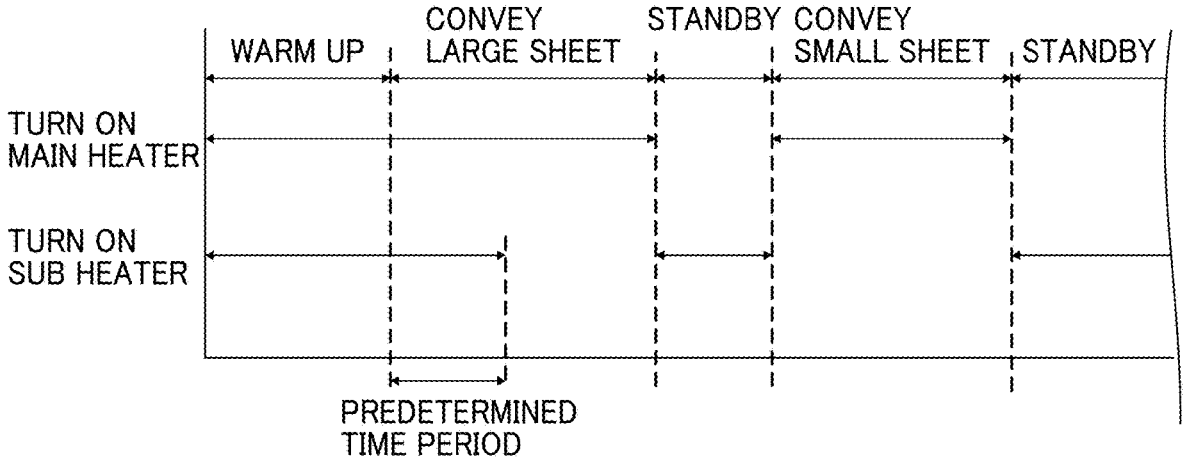
FIG. 9 is a timing chart of a control for turning on each of the main heater and the sub heater depicted in FIG. 6 as another example.

If the center portion 102*b*1 of the sub heater 102*b* also generates heat in a predetermined heat generation amount that is greater than 0 [W], the controller 150 may turn on the sub heater 102*b*, without turning on the main heater 102*a*, based on a detection result sent from the temperature detecting sensor 110, retaining the fixing belt 101 at the standby temperature as illustrated in FIG. 9. If the controller 150 turns on the sub heater 102*b* and does not turn on the main heater 102*a* in the standby mode, a heat generation amount of the sub heater 102*b* is smaller than a combined heat generation amount combining a heat generation amount of the sub heater 102*b* and a heat generation amount of the main heater 102*a* when the controller 150 turns on both the sub heater 102*b* and the main heater 102*a*. As a result, the fixing device 100 increases the lighting amount of the main heater 102*a* and the sub heater 102*b* per unit time to retain the fixing belt 101 at the standby temperature. Accordingly, if a difference between a heat generation amount of each of the lateral end portions 102*b*2 of the sub heater 102*b* and a heat generation amount of the center portion 102*b*1 of the sub heater 102*b* increases, the lateral end spans LS of the fixing belt 101 may overheat. Hence, if the controller 150 turns on the sub heater 102*b* and does not turn on the main heater 102*a* in the standby mode, the controller 150 sets the difference between the heat generation amount of each of the lateral end portions 102*b*2 of the sub heater 102*b* and the heat generation amount of the center portion 102*b*1 of the sub heater 102*b* to be smaller than that when the controller 150 turns on both the sub heater 102*b* and the main heater 102*a* in the standby mode.

If each of the guides 451 has an increased thermal capacity and is barely subject to temperature decrease, the controller 150 may turn on the main heater 102*a* without turning on the sub heater 102*b* in the standby mode also, retaining the fixing belt 101 at the standby temperature.

As described above, when a large sheet P is conveyed through the fixing nip N, the controller 150 turns on the main heater 102*a* and the sub heater 102*b* for the predetermined time period. However, even when the large sheet P is conveyed through the fixing nip N, if a toner image on the large sheet P is not conveyed over both lateral ends of the fixing belt 101 in the axial direction thereof, that suffer from temperature decrease, faulty fixing does not occur on the toner image on the large sheet P. Accordingly, if the large sheet P is conveyed through the fixing nip N and the toner image on the large sheet P is not situated in reference spans extended inboard from both lateral edges of the large sheet P in the width direction thereof, respectively, that is, if an image area rate in each of the reference spans on the large sheet P is zero, the controller 150 may turn on the main heater 102*a* without turning on the sub heater 102*b* like in a configuration in which a small sheet P is conveyed through the fixing nip N. Thus, the fixing device 100 reduces power consumption compared to the configuration in which the controller 150 turns on both the sub heater 102*b* and the main heater 102*a*.

Figure 10:
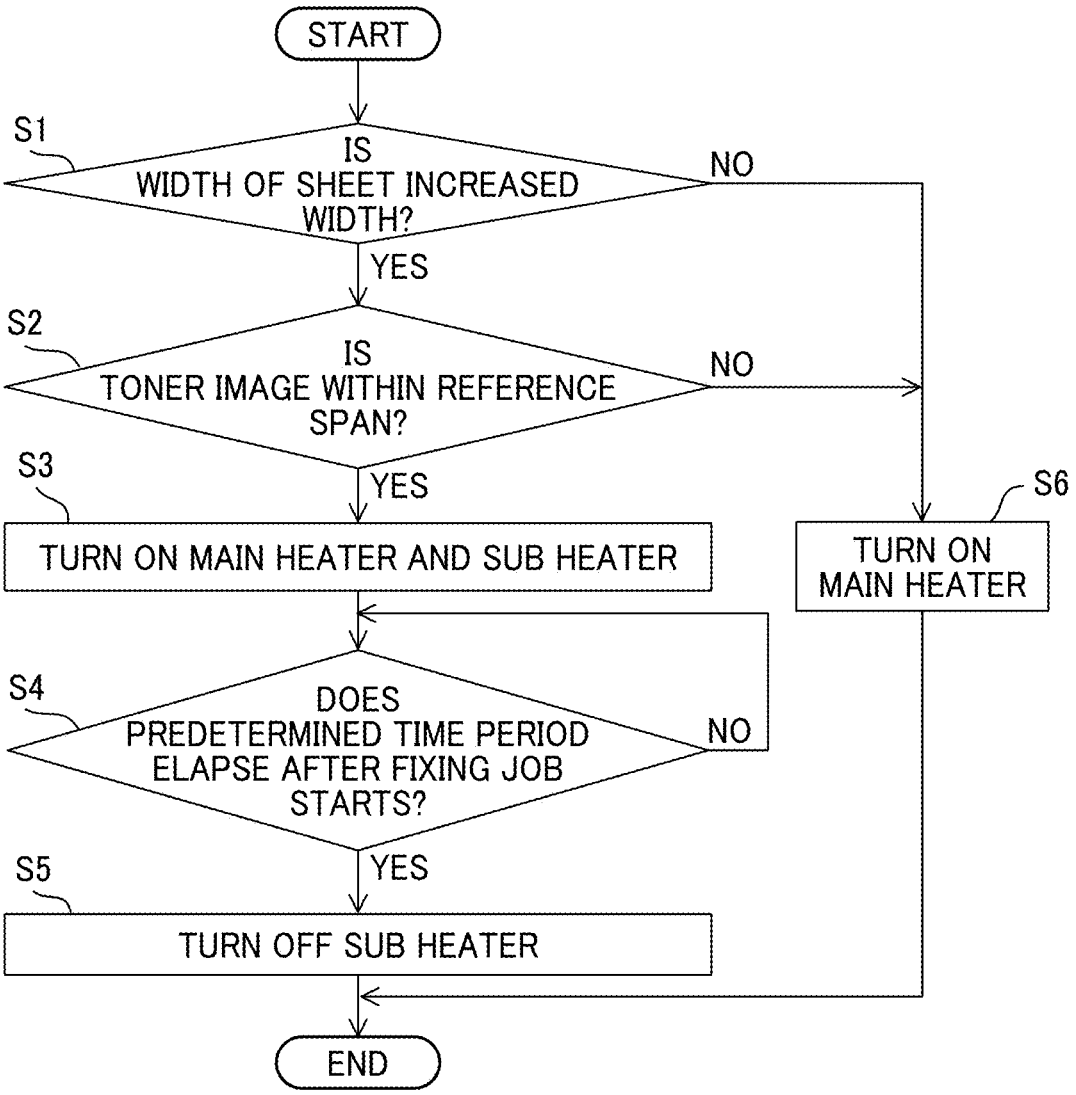
FIG. 10 is a flowchart illustrating processes of a control for turning on each of the main heater and the sub heater during fixing.

FIG. 10 is a flowchart illustrating processes of a control for turning on each of the main heater 102*a* and the sub heater 102*b* to fix a toner image on a sheet P.

When the controller 150 receives a print instruction from an external device such as a personal computer, the controller 150 reads data relating to a size (e.g., a width) of a sheet P placed in the sheet feeder 61 from the nonvolatile flash memory. In step S1, the controller 150 determines whether or not the width of the sheet P, that is read from the nonvolatile flash memory, is the increased width. For example, according to this embodiment, the increased width is not smaller than the width of the B4 size sheet in portrait orientation.

If the controller 150 determines that the width of the sheet P is the decreased width that is smaller than the width of the B4 size sheet in portrait orientation (NO in step S1), as described above, as the sheet P is conveyed over the fixing belt 101, the sheet P passes over the inboard span that is inboard from both lateral ends of the fixing belt 101 in the axial direction thereof, that may suffer from temperature decrease. Hence, the toner image on the sheet P having the decreased width is immune from an adverse effect caused by temperature decrease of the fixing belt 101. Accordingly, if the controller 150 determines that the sheet P has the decreased width, the controller 150 does not turn on the sub heater 102*b* and turns on the main heater 102*a* in step S6.

Conversely, if the controller 150 determines that the sheet P has the increased width that is not smaller than the width of the B4 size sheet in portrait orientation (YES in step S1), the controller 150 determines whether or not the toner image is within at least one of the reference spans extended inboard from the lateral edges of the sheet P in the width direction thereof based on image data according to which the toner image is formed on the sheet P in step S2. Even if the controller 150 determines that the sheet P has the increased width, if the controller 150 determines that the toner image is not within the reference spans on the sheet P, that are disposed opposite the lateral ends of the fixing belt 101 in the axial direction thereof, respectively, that may suffer from temperature decrease (NO in step S2), the controller 150 turns on the main heater 102*a* in step S6 and does not turn on the sub heater 102*b*.

Each of the reference spans extended inboard from the lateral edges of the sheet P in the width direction thereof, respectively, where faulty fixing may occur due to temperature decrease of the fixing belt 101, varies depending on the size (e.g., the width) of the sheet P. To address this circumstance, the controller 150 changes the reference span according to the size of the sheet P as indicated in table 1 below.

TABLE 1

| Width of sheet | Imaging span |
|---|---|
| A | No image within a span of X mm from a lateral edge of a sheet in a width direction thereof |
| B | No image within a span of X + Y mm from a lateral edge of a sheet in a width direction thereof |

Conversely, if the controller 150 determines that the toner image is within at least one of the reference spans extended inboard from the lateral edges of the sheet P in the width direction thereof, respectively (YES in step S2), the controller 150 turns on both the sub heater 102*b* and the main heater 102*a* in step S3. In step S4, the controller 150 determines whether or not a predetermined time period elapses after a fixing job starts, that is, after the controller 150 turns on both the main heater 102*a* and the sub heater 102*b*. If the controller 150 determines that the predetermined time period elapses after the fixing job starts (YES in step S4) and the guides 451 are heated to the temperature close to the fixing temperature, thus decreasing conduction of heat from both lateral ends of the fixing belt 101 in the axial direction thereof to the guides 451, respectively, the controller 150 turns off the sub heater 102*b* in step S5.

The predetermined time period that elapses after the controller 150 turns on the sub heater 102*b* until the controller 150 turns off the sub heater 102*b* is preferably changed according to a width of the sheet P conveyed through the fixing nip N.

Figure 11:
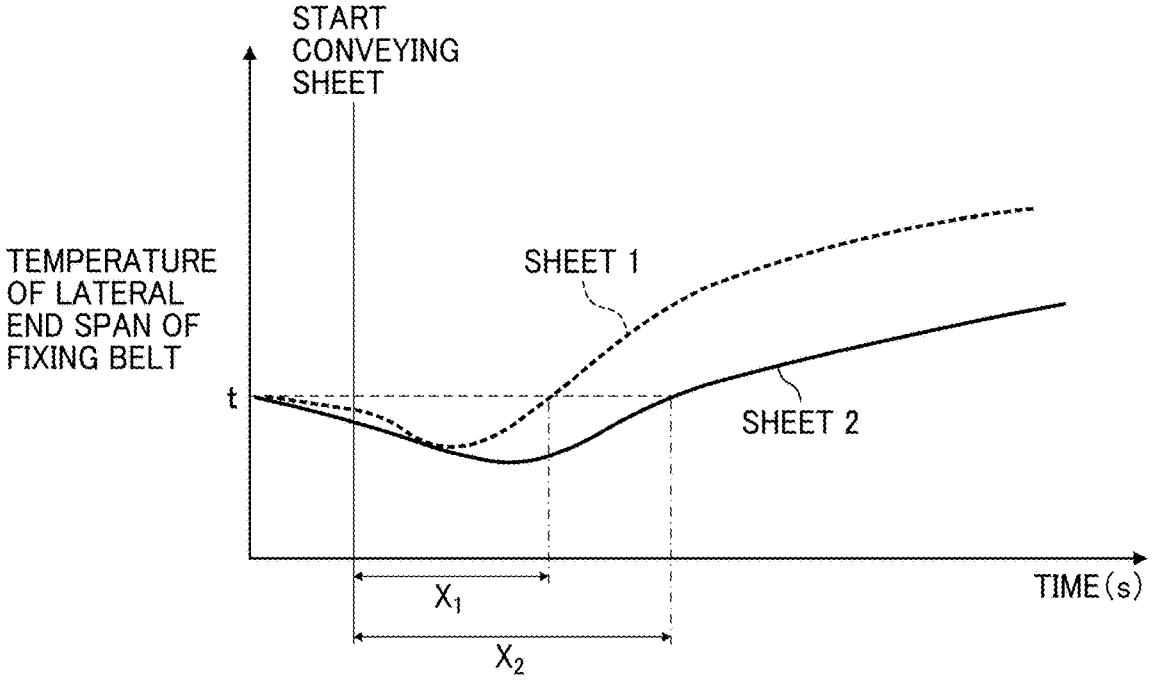
FIG. 11 is a graph illustrating temperature change of a fixing belt incorporated in the fixing device depicted in FIG. 2 in a lateral end span of the fixing belt in an axial direction thereof.

FIG. 11 is a graph illustrating temperature change of the lateral end span LS of the fixing belt 101.

As illustrated in FIG. 11, the controller 150 turns on both the sub heater 102*b* and the main heater 102*a* to heat the fixing belt 101 to a fixing temperature t. Thereafter, the controller 150 turns off the sub heater 102*b*. Thus, the temperature of the lateral end span LS of the fixing belt 101 changes when sheets 1 and 2 are conveyed through the fixing nip N. Each of the sheets 1 and 2 has a width not smaller than the width of 257 mm of the B4 size sheet in portrait orientation. The width of the sheet 1 is different from the width of the sheet 2.

When the sheet 1 smaller than the sheet 2 in the width is conveyed through the fixing nip N, the sheet 1 draws heat less than the sheet 2 from both lateral end spans LS of the fixing belt 101. Hence, the sheet 1 causes an amount of heat conducted from both lateral end spans LS of the fixing belt 101 to the guides 451 to be greater than that caused by the sheet 2. Accordingly, the guides 451 are heated to the temperature close to the fixing temperature tin a shortened time period. Consequently, the lateral end spans LS of the fixing belt 101 recover the fixing temperature tin the shortened time period, eliminating temperature decrease of the fixing belt 101 in the lateral end spans LS. For example, when $X_1$ seconds elapse after conveyance of the sheet 1 through the fixing nip N starts, even if the controller 150 turns on the main heater 102*a* and does not turn on the sub heater 102*b*, temperature decrease in the lateral end spans LS of the fixing belt 101 does not occur.

Conversely, when the sheet 2 greater than the sheet 1 in the width is conveyed through the fixing nip N, the sheet 2 draws heat more than the sheet 1 from the lateral end spans LS of the fixing belt 101. Hence, conduction of heat from the lateral end spans LS of the fixing belt 101 to the guides 451, respectively, decreases. Accordingly, heat is conducted from the lateral end spans LS of the fixing belt 101 to the guides 451, respectively, for an increased time period, taking time for the lateral end spans LS of the fixing belt 101 to recover the fixing temperature t. For example, when $X_2$ seconds that are longer than $X_1$ seconds elapse after conveyance of the sheet 2 through the fixing nip N starts, even if the controller 150 turns on the main heater 102*a* and does not turn on the sub heater 102*b*, temperature decrease in the lateral end spans LS of the fixing belt 101 does not occur.

As described above, even if the controller 150 turns on the main heater 102*a* and does not turn on the sub heater 102*b*, a time period taken to eliminate temperature decrease in the lateral end spans LS of the fixing belt 101 varies depending on the width of a sheet P conveyed through the fixing nip N. Hence, as illustrated in table 2 below, the predetermined time period that elapses after the controller 150 turns on the sub heater 102*b* until the controller 150 turns off the sub heater 102*b* is preferably changed according to the width of the sheet P.

TABLE 2

| Width of sheet | Predetermined time period |
|---|---|
| A | X seconds |
| B(A < B) | X + Y seconds |

The predetermined time period that elapses after the controller 150 turns on the sub heater 102*b* until the controller 150 turns off the sub heater 102*b* during fixing is preferably changed between a first image formation after the printer 200 is powered on and a later image formation after the printer 200 enters the standby mode. For example, when the printer 200 is powered on, the guides 451 including the guide portions 451*a* that contact both lateral ends of the fixing belt 101 in the axial contact thereof, respectively, have a substantially ambient temperature. Hence, it takes longer time for the guides 451 to be heated to the temperature close to the fixing temperature by conduction of heat from the lateral end spans LS of the fixing belt 101 to the guides 451 compared to the later image formation after the printer 200 enters the standby mode. Accordingly, during the first image formation after the printer 200 is powered on, the controller 150 increases the predetermined time period that elapses after the controller 150 turns on the sub heater 102*b* until the controller 150 turns off the sub heater 102*b* compared to the later image formation after the printer 200 enters the standby mode.

As described above, the controller 150 determines whether or not the toner image is within at least one of the reference spans extended inboard from the lateral edges of the sheet P in the width direction thereof, respectively, and determines whether the controller 150 turns on the main heater 102*a* without turning on the sub heater 102*b* or turns on both the sub heater 102*b* and the main heater 102*a*. Alternatively, the controller 150 may determine turning on of the sub heater 102*b* and the main heater 102*a* as described below. For example, based on a distance from the lateral edge of the fixing belt 101 to a lateral edge of a toner image on a sheet P in the axial direction of the fixing belt 101, the controller 150 may determine whether the controller 150 turns on the main heater 102*a* without turning on the sub heater 102*b* or turns on both the sub heater 102*b* and the main heater 102*a*.

As described above, if the controller 150 determines that the toner image is within at least one of the reference spans extended inboard from the lateral edges of the sheet P in the width direction thereof, respectively, for example, if the image area rate in at least one of the reference spans on the sheet P is greater than zero, the controller 150 turns on both the sub heater 102*b* and the main heater 102*a*. However, the lateral end spans LS of the fixing belt 101 may barely suffer from temperature decrease depending on a configuration of the fixing device 100. With the configuration of the fixing device 100, that barely generates temperature decrease of the fixing belt 101, for example, if the controller 150 determines that the image area rate in the reference span extended inboard from the lateral edge of the sheet P in the width direction thereof is not smaller than a predetermined value, the controller 150 may turn on both the sub heater 102*b* and the main heater 102*a*. Even if the controller 150 determines that the toner image is within the reference span extended inboard from the lateral edge of the sheet P in the width direction thereof, if the image area rate is small, the toner image draws slight heat from the fixing belt 101. Accordingly, even if the lateral end spans LS of the fixing belt 101 suffer from temperature decrease, the fixing belt 101 fixes the toner image on the sheet P properly in the reference span extended inboard from the lateral edge of the sheet P in the width direction thereof.

The fixing device 100 may include a power interrupter that interrupts power supply to the sub heater 102*b* and the main heater 102*a* when the power interrupter detects an abnormal temperature of the surface of the fixing belt 101.

The power interrupter is a thermopile, a thermal fuse, or the like. The power interrupter may include an abnormal temperature detecting sensor serving as an abnormal temperature detector such as a thermopile that is inferior to the temperature detecting sensor 110 in temperature responsiveness and is manufactured at reduced costs. The power interrupter interrupts power supply to the sub heater 102*b* and the main heater 102*a* based on a detection result sent from the abnormal temperature detecting sensor.

The thermopile, the thermal fuse, or the abnormal temperature detecting sensor is disposed opposite the fixing belt 101. When the fixing belt 101 is heated to a predetermined temperature, the power interrupter is activated and interrupts power supply to the sub heater 102*b* and the main heater 102*a*.

Figure 12:
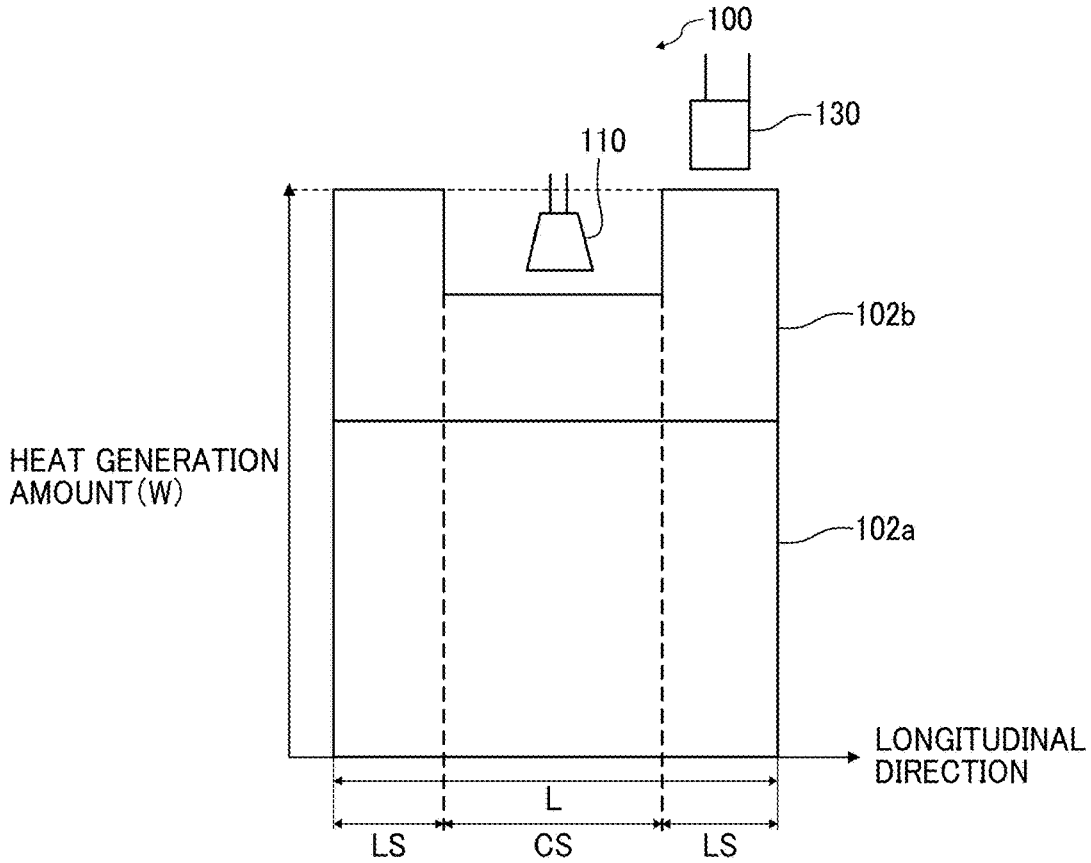
FIG. 12 is a diagram of the fixing device depicted in FIG. 6, illustrating a power interrupter disposed opposite the lateral end span of the fixing belt in the axial direction thereof.

FIG. 12 illustrates a power interrupter 130 (e.g., the thermopile, the thermal fuse, or the abnormal temperature detecting sensor) that is disposed opposite the lateral end span LS of the fixing belt 101. The lateral end span LS of the fixing belt 101 receives heat in an increased amount when the main heater 102*a* and the sub heater 102*b* are turned on and therefore is subject to temperature increase. When a small sheet P having the decreased width in the width direction of the small sheet P is conveyed through the fixing nip N also, the lateral end span LS of the fixing belt 101 is subject to temperature increase. To address this circumstance, the power interrupter 130 is disposed opposite the lateral end span LS of the fixing belt 101 so that the power interrupter 130 detects an abnormal temperature of the fixing belt 101 early and interrupts power supply to each of the main heater 102*a* and the sub heater 102*b*.

According to this embodiment, when printing is performed continuously on a great number of small sheets P having the decreased width in the width direction thereof, a temperature of each of the lateral end spans LS of the fixing belt 101 tends to be higher than a temperature of the center span CS of the fixing belt 101. Since the small sheets P that pass through the fixing nip N successively are conveyed over the center span CS of the fixing belt 101, the small sheets P draw heat from the center span CS of the fixing belt 101. Conversely, the small sheets P barely draw heat from the lateral end spans LS of the fixing belt 101. Accordingly, after the guides 451 are heated to the temperature close to the fixing temperature, heat conducted from the main heater 102*a* to the lateral end spans LS of the fixing belt 101 is drawn to the small sheets P and other elements less than heat conducted to the center span CS of the fixing belt 101. Consequently, when printing is performed continuously on the great number of small sheets P, the temperature of each of the lateral end spans LS of the fixing belt 101 tends to be higher than the temperature of the center span CS of the fixing belt 101.

To address this circumstance, a thermal equalizer may be interposed between the pad 106 and the inner circumferential surface of the fixing belt 101. The thermal equalizer facilitates conduction of heat in a longitudinal direction thereof and decreases unevenness of the temperature of the fixing belt 101 in a longitudinal direction, that is, the axial direction thereof. The thermal equalizer conducts heat from the lateral end spans LS to the center span CS of the fixing belt 101. Accordingly, the thermal equalizer suppresses temperature decrease in the center span CS of the fixing belt 101 and suppresses temperature increase in the lateral end spans LS of the fixing belt 101. Since the thermal equalizer suppresses temperature decrease in the center span CS of the fixing belt 101, while the controller 150 performs a control to retain the fixing belt 101 at the fixing temperature based on a detection result sent from the temperature detecting sensor 110, the controller 150 suppresses a lighting amount per unit time of the main heater 102*a*. Accordingly, the controller 150 suppresses a heating amount per unit time of heat supplied to the lateral end spans LS of the fixing belt 101, thus, suppressing temperature increase in the lateral end spans LS of the fixing belt 101.

The thermal equalizer eliminates temperature decrease in the lateral end spans LS of the fixing belt 101 quickly, shortening a lighting time period for which the controller 150 turns on both the main heater 102*a* and the sub heater 102*b* when a large sheet P having the increased width in the width direction of the large sheet P is conveyed through the fixing nip N. Thus, the thermal equalizer reduces power consumption of the fixing device 100.

The above describes the embodiments of the present disclosure, that are applied to the fixing device 100 employing a belt fixing method using the fixing belt 101. The embodiments of the present disclosure are also applied to a fixing device employing a roller fixing method using a fixing roller.

The above describes one example of the technology of the present disclosure. The technology of the present disclosure achieves advantages peculiar to aspects described below.

A description is provided of a first aspect of the technology of the present disclosure.

As illustrated in FIGS. 2 and 6, the fixing device 100 includes a fixing rotator (e.g., the fixing belt 101) and a plurality of heaters that heats the fixing rotator and has different heat generation properties, respectively. While a recording medium (e.g., a sheet P) bearing an image (e.g., a toner image) is conveyed over the fixing rotator, the fixing device 100 fixes the image on the recording medium. The plurality of heaters includes a first heater (e.g., main heater 102*a*) and a second heater (e.g., the sub heater 102*b*). The first heater has a heat generation property in which the first heater generates heat evenly, that is, generates a heat generation amount that is even in an axial direction of the fixing rotator, in a maximum conveyance span (e.g., the heat generation span L) on the fixing rotator in the axial direction thereof. A recording medium having a maximum width, that is available for the fixing rotator, in a width direction of the recording medium, that is parallel to the axial direction of the fixing rotator, is conveyed over the maximum conveyance span on the fixing rotator. The second heater generates heat in the maximum conveyance span. The second heater includes a first portion (e.g., the center portion 102*b*1) and a second portion (e.g., the lateral end portions 102*b*2). The second heater has a heat generation property in which a heat generation amount of the second portion is greater than a heat generation amount of the first portion.

For example, the first portion of the second heater is disposed opposite a center span (e.g., the center span CS) of the fixing rotator in the axial direction thereof. The second portion of the second heater is disposed opposite a lateral end span (e.g., the lateral end span LS) of the fixing rotator in the axial direction thereof.

A comparative fixing device includes a main heater including a center portion and both lateral end portions in a longitudinal direction of the main heater. The main heater has a heat generation property in which a heat generation amount of the center portion is greater than a heat generation amount of each of the lateral end portions. The comparative fixing device further includes a sub heater including a center portion and both lateral end portions in a longitudinal direction of the sub heater. The sub heater has a heat generation property in which a heat generation amount of each of the lateral end portions is greater than a heat generation amount of the center portion and in which the heat generation amount of each of the lateral end portions of the sub heater is greater than the heat generation amount of the center portion of the main heater. With the heat generation properties described above, when a controller turns on the main heater and does not turn on the sub heater, both lateral end spans of a fixing rotator in an axial direction thereof suffer from temperature decrease. Conversely, when the controller turns on the sub heater and does not turn on the main heater, a center span of the fixing rotator in the axial direction thereof suffers from temperature decrease. To address this circumstance, the comparative fixing device includes a first temperature detecting sensor and a second temperature detecting sensor. The controller controls the main heater based on a temperature of the center span of the fixing rotator in the axial direction thereof, that is detected by the first temperature detecting sensor. The controller controls the sub heater based on a temperature of the lateral end span of the fixing rotator in the axial direction thereof, that is detected by the second temperature detecting sensor. Thus, the comparative fixing device retains the fixing rotator at a predetermined temperature (e.g., a standby temperature or a fixing temperature) substantially throughout an entire span of the fixing rotator in the axial direction thereof.

Conversely, according to the first aspect of the technology of the present disclosure, as illustrated in FIG. 6, the first heater (e.g., the main heater 102*a*) has the heat generation property in which the first heater generates the heat generation amount that is even in the axial direction of the fixing rotator. Accordingly, when a controller (e.g., the controller 150) turns on the first heater and does not turn on the second heater, the first heater heats the fixing rotator evenly in the axial direction thereof. When the controller turns on the first heater and the second heater, a combined heat generation amount combining the heat generation amount of the first heater and the heat generation amount of the second portion of the second heater in a second span (e.g., the lateral end span LS) in the axial direction of the fixing rotator is greater than a combined heat generation amount combining the heat generation amount of the first heater and the heat generation amount of the first portion of the second heater in a first span (e.g., the center span CS) in the axial direction of the fixing rotator.

For example, when a lateral end contact member (e.g., the guide 451) that contacts the second span of the fixing rotator has a decreased temperature when the fixing device 100 is powered on, an amount of heat conducted from the second span of the fixing rotator to the lateral end contact member increases. To address this circumstance, the controller turns on the first heater and the second heater, causing the combined heat generation amount in the second span to be greater than the combined heat generation amount in the first span. Thus, the fixing rotator achieves an even temperature substantially throughout an entire span of the fixing rotator in the axial direction thereof. When the first heater and the second heater heat the fixing rotator for a predetermined time period, the lateral end contact member achieves a temperature equivalent to a temperature of the fixing rotator. Accordingly, an amount of heat conducted from the second span of the fixing rotator to the lateral end contact member decreases. Thus, even if the combined heat generation amount in the second span is not greater than the combined heat generation amount in the first span, the fixing rotator achieves the even temperature substantially throughout the entire span of the fixing rotator in the axial direction thereof. Hence, after the first heater and the second heater heat the fixing rotator for the predetermined time period, the controller turns off the second heater and turns on the first heater to retain the fixing rotator at the predetermined temperature based on a detection result sent from the temperature detecting sensor, retaining the fixing rotator at the predetermined temperature substantially throughout the entire span of the fixing rotator in the axial direction thereof. As described above, after the first heater and the second heater heat the fixing rotator for the predetermined time period, the first heater retains the fixing rotator at the predetermined temperature substantially throughout the entire span of the fixing rotator in the axial direction thereof, allowing the fixing device 100 to eliminate a temperature detecting sensor used for the second heater. Accordingly, the fixing device 100 according to the first aspect reduces the number of temperature sensors compared to the comparative fixing device, retaining the fixing rotator at the predetermined temperature substantially throughout the entire span of the fixing rotator in the axial direction thereof. Consequently, the fixing device 100 reduces manufacturing costs.

A description is provided of a second aspect of the technology of the present disclosure.

Based on the first aspect, when the fixing rotator fixes an image on a recording medium having a decreased width smaller than a reference width (e.g., the width of the B4 size sheet in portrait orientation according to the embodiments) in the width direction of the recording medium, the controller turns on the first heater to heat the fixing rotator without turning on the second heater. When the fixing rotator fixes an image on a recording medium having an increased width not smaller than the reference width in the width direction of the recording medium, the controller turns on the first heater without turning on the second heater or turns on both the first heater and the second heater to heat the fixing rotator.

Accordingly, as described above in the embodiments, if the recording medium has the decreased width smaller than the reference width in the width direction of the recording medium, the controller turns on the first heater to heat the fixing rotator without turning on the second heater. Thus, the fixing device 100 suppresses temperature increase in the second span (e.g., the lateral end span LS) of the fixing rotator compared to a configuration in which the controller turns on the first heater and the second heater to heat the fixing rotator.

If the recording medium has the increased width not smaller than the reference width in the width direction of the recording medium, based on a condition of temperature decrease in the second span of the fixing rotator and the image formed on the recording medium, the controller turns on the first heater without turning on the second heater or turns on both the first heater and the second heater to heat the fixing rotator that fixes the image on the recording medium.

A description is provided of a third aspect of the technology of the present disclosure.

Based on the second aspect, when the fixing rotator fixes the image on the recording medium having the increased width in the width direction of the recording medium, until the controller determines that a predetermined time period elapses after a fixing job starts, that is, after the controller turns on both the first heater and the second heater, the first heater and the second heater heat the fixing rotator. When the controller determines that the predetermined time period elapses, the controller turns on the first heater to heat the fixing rotator without turning on the second heater.

Accordingly, as described above in the embodiments, when the predetermined time period elapses after the fixing job starts, conduction of heat from the second span (e.g., the lateral end span LS) of the fixing rotator to the lateral end contact member decreases. Accordingly, even if the combined heat generation amount in the second span is not greater than the combined heat generation amount in the first span (e.g., the center span CS), the second span of the fixing rotator does not suffer from temperature decrease. Hence, until the controller determines that the predetermined time period elapses, the controller turns on both the first heater and the second heater to heat the fixing rotator. Thus, the fixing device 100 suppresses temperature decrease in the second span of the fixing rotator. When the controller determines that the predetermined time period elapses, the controller turns on the first heater to heat the fixing rotator without turning on the second heater. Thus, the fixing device 100 prevents a temperature of the second span of the fixing rotator from being higher than a temperature of the first span of the fixing rotator.

A description is provided of a fourth aspect of the technology of the present disclosure.

Based on the third aspect, the controller determines the predetermined time period based on a width of the recording medium in the width direction thereof.

Accordingly, as described above in the embodiments, if the recording medium has the decreased width, conduction of heat from the second span (e.g., the lateral end span LS) of the fixing rotator to the lateral end contact member decreases early. Accordingly, even if the combined heat generation amount in the second span is not greater than the combined heat generation amount in the first span (e.g., the center span CS), the second span of the fixing rotator does not suffer from temperature decrease. Hence, the controller determines the predetermined time period based on the width of the recording medium in the width direction thereof. Thus, the fixing device 100 suppresses temperature decrease in the second span of the fixing rotator properly. Additionally, the fixing device 100 prevents a temperature of the second span of the fixing rotator from being higher than a temperature of the first span of the fixing rotator.

A description is provided of a fifth aspect of the technology of the present disclosure.

Based on any one of the second to fourth aspects, if the controller determines that the recording medium has the increased width and that an image area rate in a reference span extended inboard from a lateral edge of the recording medium in the width direction thereof is not greater than a threshold, the controller turns on the first heater to heat the fixing rotator without turning on the second heater.

Accordingly, as described above in the embodiments, even if the recording medium conveyed through a fixing nip (e.g., the fixing nip N) has the increased width, if the image area rate in the reference span extended inboard from the lateral edge of the recording medium in the width direction thereof is not greater than the threshold, even if the second span (e.g., the lateral end span LS) of the fixing rotator suffers from temperature decrease, the image on the recording medium does not suffer from faulty fixing. Hence, if the controller determines that the recording medium has the increased width and that the image area rate in the reference span extended inboard from the lateral edge of the recording medium in the width direction thereof is not greater than the threshold, the controller turns on the first heater to heat the fixing rotator without turning on the second heater. Accordingly, the fixing device 100 suppresses faulty fixing and reduces power consumption compared to the configuration in which the controller turns on the first heater and the second heater to heat the fixing rotator.

A description is provided of a sixth aspect of the technology of the present disclosure.

Based on the fifth aspect, the controller determines the reference span based on the width of the recording medium in the width direction thereof.

Accordingly, as described above in the embodiments, the reference span extended inboard from the lateral edge of the recording medium in the width direction thereof, where faulty fixing may occur due to temperature decrease in the second span (e.g., the lateral end span LS) of the fixing rotator, varies depending on the width of the recording medium. To address this circumstance, the controller determines the reference span based on the width of the recording medium in the width direction thereof. Accordingly, the fixing device 100 suppresses faulty fixing effectively and reduces power consumption compared to the configuration in which the controller turns on the first heater and the second heater to heat the fixing rotator.

A description is provided of a seventh aspect of the technology of the present disclosure.

Based on any one of the first to sixth aspects, a temperature detecting sensor (e.g., the temperature detecting sensor 110) is disposed opposite the fixing rotator in a minimum conveyance span (e.g., the center span CS) where the recording medium having a minimum width in the width direction thereof, that is available for the fixing rotator, is conveyed over the fixing rotator. The controller controls the first heater based on a detection result sent from the temperature detecting sensor.

Accordingly, the fixing device 100 retains the fixing rotator at the predetermined temperature (e.g., the fixing temperature).

A description is provided of an eighth aspect of the technology of the present disclosure.

Based on any one of the first to seventh aspects, the controller turns on the second heater without turning on the first heater or turns on both the first heater and the second heater to heat the fixing rotator in a standby mode in which the fixing device 100 waits for a fixing job.

Accordingly, as described above in the embodiments, the fixing device 100 suppresses temperature decrease in the second span (e.g., the lateral end span LS) of the fixing rotator in the standby mode.

A description is provided of a ninth aspect of the technology of the present disclosure.

Based on any one of the first to eighth aspects, if the controller determines that a temperature of the second span (e.g., the lateral end span LS) of the fixing rotator is not lower than a threshold, a power interrupter (e.g., the power interrupter 130) depicted in FIG. 12, that is disposed opposite the fixing rotator, interrupts power supply to each of the first heater and the second heater.

Accordingly, as described above in the embodiments, the power interrupter detects a temperature of the second span of the fixing rotator and interrupts power supply to the first heater and the second heater based on the detected temperature. Thus, the power interrupter detects an abnormal temperature of the fixing rotator early and interrupts power supply to the first heater and the second heater.

A description is provided of a tenth aspect of the technology of the present disclosure.

Based on any one of the first to ninth aspects, a heat generation amount of each of the first span (e.g., the center span CS) and the second span (e.g., the lateral end span LS) of the first heater in the axial direction of the fixing rotator is greater than a heat generation amount of the first portion (e.g., the center portion 102*b*1) of the second heater.

Accordingly, the controller turns on the first heater without turning on the second heater. Consequently, the fixing device 100 retains the fixing rotator at the predetermined temperature (e.g., the fixing temperature) properly.

A description is provided of an eleventh aspect of the technology of the present disclosure.

As illustrated in FIG. 1, an image forming apparatus (e.g., the printer 200) includes an image forming device that forms an image on a recording medium (e.g., a sheet P) and a fixing device (e.g., the fixing device 100) that fixes the image on the recording medium. The image forming device includes an image bearer (e.g., the photoconductive drums 20Y, 20C, 20M, and 20Bk) that bears the image. The fixing device is configured based on any one of the first to tenth aspects.

Accordingly, the image forming apparatus reduces manufacturing costs and forms the image properly.

According to the embodiments described above, the fixing device 100 employs a center reference conveyance system in which a sheet P serving as a recording medium is centered on the fixing belt 101 while the sheet P is conveyed over the fixing belt 101. Alternatively, the fixing device 100 may employ a lateral end reference conveyance system in which a sheet P is aligned along a lateral end of the fixing belt 101 in the axial direction thereof while the sheet P is conveyed over the fixing belt 101.

According to the embodiments described above, the fixing belt 101 serves as a fixing rotator. Alternatively, a fixing roller, a fixing film, a fixing sleeve, or the like may be used as a fixing rotator. Further, the pressure roller 103 serves as a pressure rotator. Alternatively, a pressure belt or the like may be used as a pressure rotator.

According to the embodiments described above, the printer 200 serves as an image forming apparatus. Alternatively, the image forming apparatus may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A fixing device comprising:

a fixing rotator over which a recording medium bearing an image is conveyed;

a first heater to heat the fixing rotator and generate heat evenly in a maximum conveyance span where the recording medium having a maximum width in a width direction of the recording medium is conveyed, the maximum width being available for the fixing rotator;

a second heater to heat the fixing rotator and generate heat in the maximum conveyance span, the second heater including:

a first portion to generate heat in a first heat generation amount; and a second portion to generate heat in a second heat generation amount that is greater than the first heat generation amount of the first portion; and a controller configured to control the first heater and the second heater, wherein the controller is configured to turn on the first heater and the second heater for a predetermined time period if the controller determines that the recording medium has the increased width in the width direction of the recording medium, wherein the controller is configured to turn off the second heater after the predetermined time period elapse, and wherein the controller is configured to determine the predetermined time period based on a width of the recording medium in the width direction of the recording medium.

2. The fixing device according to claim 1, wherein the first portion of the second heater is disposed in a center span of the second heater in an axial direction of the fixing rotator, and wherein the second portion of the second heater is disposed in each lateral end span of the second heater in the axial direction of the fixing rotator.

3. The fixing device according to claim 1, wherein the controller is configured to turn on the first heater without turning on the second heater if the controller determines that the recording medium has a decreased width that is smaller than a reference width in the width direction of the recording medium.

4. The fixing device according to claim 1, further comprising a temperature detecting sensor disposed opposite the fixing rotator in a minimum conveyance span where the recording medium having a minimum width in the width direction of the recording medium is conveyed, the minimum width being available for the fixing rotator, wherein the controller is configured to control the first heater based on a detection result sent from the temperature detecting sensor.

5. The fixing device according to claim 1, wherein the controller is configured to turn on at least the second heater in a standby mode.

6. The fixing device according to claim 1, further comprising a power interrupter to detect a temperature of a lateral end span of the fixing rotator in an axial direction of the fixing rotator, and the power interrupter interrupts power supply to the first heater and the second heater if the temperature of the lateral end span of the fixing rotator in the axial direction of the fixing rotator is not lower than a threshold.

7. The fixing device according to claim 1, wherein a heat generation amount of each of a first span and a second span of the first heater in an axial direction of the fixing rotator is greater than the first heat generation amount of the first portion of the second heater.

8. The fixing device according to claim 1, further comprising a guide to contact a lateral end of the fixing rotator in an axial direction of the fixing rotator.

9. The fixing device according to claim 1, wherein the fixing rotator includes a fixing belt.

10. An image forming apparatus comprising:

an image bearer to bear an image; and a fixing device to fix the image on a recording medium, the fixing device including:

a fixing rotator over which the recording medium bearing the image is conveyed;

a first heater to heat the fixing rotator and generate heat evenly in a maximum conveyance span where the recording medium having a maximum width in a width direction of the recording medium is conveyed, the maximum width being available for the fixing rotator; and a second heater to heat the fixing rotator and generate heat in the maximum conveyance span, the second heater including:

a first portion to generate heat in a first heat generation amount; and a second portion to generate heat in a second heat generation amount that is greater than the first heat generation amount of the first portion; and a controller configured to control the first heater and the second heater, wherein the controller is configured to turn on the first heater and the second heater for a predetermined time period if the controller determines that the recording medium has the increased width in the width direction of the recording medium, wherein the controller is configured to turn off the second heater after the predetermined time period elapse, and wherein the controller is configured to determine the predetermined time period based on a width of the recording medium in the width direction of the recording medium.

11. A fixing device comprising:

a fixing rotator over which a recording medium bearing an image is conveyed;

a first heater to heat the fixing rotator and generate heat evenly in a maximum conveyance span where the recording medium having a maximum width in a width direction of the recording medium is conveyed, the maximum width being available for the fixing rotator;

a second heater to heat the fixing rotator and generate heat in the maximum conveyance span, the second heater including:

a first portion to generate heat in a first heat generation amount; and a second portion to generate heat in a second heat generation amount that is greater than the first heat generation amount of the first portion; and a controller configured to control the first heater and the second heater, wherein the controller is configured to turn on the first heater without turning on the second heater if the controller determines that the recording medium has the increased width in the width direction of the recording medium and that an image area rate in a reference span extended inboard from a lateral edge of the recording medium in the width direction of the recording medium is not greater than a threshold; and wherein the controller is configured to determine the reference span based on a width of the recording medium in the width direction of the recording medium.

* * * * *